US005538837A

United States Patent [19]

Mihayashi et al.

[11] Patent Number: 5,538,837

[45] Date of Patent: Jul. 23, 1996

[54] SILVER HALIDE COLOR PHOTOGRAPHIC LIGHT-SENSITIVE MATERIAL

[75] Inventors: Keiji Mihayashi; Seiji Ichijima; Toshio Kawagishi, all of Kanagawa, Japan

[73] Assignee: Fuji Photo Film Co., Ltd., Kanagawa, Japan

[21] Appl. No.: 323,069

[22] Filed: Oct. 14, 1994

Related U.S. Application Data

[63] Continuation of Ser. No. 181,234, Jan. 13, 1994, abandoned.

[30] Foreign Application Priority Data

Jan. 14, 1993 [JP] Japan ..... 5-020722

[51] Int. Cl.[6] ..... G03C 1/46

[52] U.S. Cl. ..... 430/505; 430/544; 430/549; 430/957

[58] Field of Search ..... 430/505, 957, 430/544, 549

[56] References Cited

U.S. PATENT DOCUMENTS

| | | | |
|---|---|---|---|
| 4,477,563 | 10/1984 | Ichijima et al. | 430/544 |
| 4,782,012 | 11/1988 | DeSelms et al. | 430/544 |
| 4,962,018 | 10/1990 | Szajewski et al. | 430/544 |
| 5,151,343 | 9/1992 | Begley et al. | 430/544 |
| 5,212,052 | 5/1993 | Sakanoue et al. | 430/503 |
| 5,238,803 | 8/1993 | Ichijima et al. | 430/556 |
| 5,250,406 | 10/1993 | Yamamoto et al. | 430/544 |
| 5,256,523 | 10/1993 | Szajewski et al. | 430/362 |
| 5,286,613 | 2/1994 | Begley et al. | 430/544 |
| 5,294,524 | 3/1994 | Ishii et al. | 430/503 |
| 5,294,527 | 3/1994 | Deguchi | 430/545 |
| 5,306,609 | 4/1994 | Mihayashi et al. | 430/557 |
| 5,310,642 | 5/1994 | Vargas et al. | 430/544 |

FOREIGN PATENT DOCUMENTS

| | | |
|---|---|---|
| 0204175 | 12/1986 | European Pat. Off. . |
| 0412532 | 2/1991 | European Pat. Off. . |
| 0522371 | 1/1993 | European Pat. Off. . |
| 0577184 | 1/1994 | European Pat. Off. . |

*Primary Examiner*—Geraldine Letscher
*Attorney, Agent, or Firm*—Sughrue, Mion, Zinn, Macpeak & Seas

[57] ABSTRACT

A silver halide color photographic light-sensitive material which causes less fluctuation in the photographic processing activity of a processing solution in continuously processing the light-sensitive material and which has less unevenness in processing and excellent color reproducibility and sharpness. The silver halide color photographic light-sensitive material comprises a support, and provided thereon at least one red-sensitive emulsion layer, at least one green-sensitive emulsion layer, and at least one blue-sensitive emulsion layer, and containing a coupler represented by the following Formula (I) and a coupler represented by the following Formula (II):

Formula (I)

$$A_1\text{–(TIME)}_a\text{–}DI$$

Formula (II)

$$A_2\text{–(TIME)}_a\text{–}DI$$

wherein $A_1$ represents a group having an anti-diffusion group and releasing $(TIME)_a$–DI upon a reaction with an oxidation product of an aromatic primary amine developing agent; $A_2$ represents a group having no anti-diffusion group and releasing $(TIME)_a$–DI upon a reaction with an oxidation product of an aromatic primary amine developing agent; TIME represents a timing group which splits from DI after separating from A; DI represents a development inhibitor which is substantially deactivated after eluting in a developing solution; and a represents 1 or 2, and when a is 2, the two TIME's are the same or different.

4 Claims, No Drawings

SILVER HALIDE COLOR PHOTOGRAPHIC LIGHT-SENSITIVE MATERIAL

This is a continuation of application Ser. No. 08/181,234, filed Jan. 13, 1994, abandoned.

FIELD OF THE INVENTION

The present invention relates to a silver halide color photographic light-sensitive material, specifically to a silver halide color photographic light-sensitive material which causes less fluctuation in the photographic processing activity of a processing solution in continuously processing the light-sensitive material and which has less unevenness in image density caused by fluctuation of processing and excellent color reproducibility and sharpness.

BACKGROUND OF THE INVENTION

In a silver halide color photographic light-sensitive material, particularly a color light-sensitive material for photographing, there is required a light-sensitive material having good color reproducibility and sharpness and exhibiting no adverse affect on the photographic processing activity of a processing solution in continuously processing the light-sensitive material.

The novel DIR coupler in which a dye formed from the coupler is eluted in a developing solution after a color development was proposed in JP-A-58-162949 ( the term "JP-A" as used herein means an unexamined published Japanese patent application) and JP-A-63-37350 for the purpose of improving a sharpness, a color reproducibility, and a light-sensitive material storing performance. The sharpness, color reproducibility and light-sensitive material storing performance were certainly improved by using these DIR couplers. However, there was involved the problem that the application only of these couplers markedly increased the fluctuation in the activity of a developing solution.

Further, there are proposed in, for example, U.S. Pat. No. 4,782,012, and JP-A-57-151944, JP-A-3-198048, and JP-A-3-228048, light-sensitive materials which contain DIR couplers having structures similar to those of the couplers of the present invention represented by Formula (I) and Formula (II) and have improved color reproducibility, sharpness and storing performance of the light-sensitivity, and which are designed so that a development inhibitor eluted in a processing solution is deactivated therein to thereby allow the adverse affects to be less liable to be exerted to the processing activity in a continuous processing. Certainly, an interlayer effect and an edge effect were improved by using these DIR couplers and the color reproducibility and sharpness were improved to some extent. However, the effects thereof remained still insufficient. Further, the adverse effect to the processing activity in the continuous processing was decreased, but in the case where a recent color developing solution having a reduced replenishing amount was used, there still remained the problem that the fluctuation in the activity of the developing solution was still larger.

SUMMARY OF THE INVENTION

A first object of the present invention is to provide a light-sensitive material having less fluctuation fatigue in the photographic performances of a processing solution in continuously processing the light-sensitive material.

A second object of the present invention is to provide a light-sensitive material in which an unevenness in image density is less liable to generate in the processing.

A third object of the present invention is to provide a light-sensitive material having excellent sharpness, color reproducibility and graininess altogether.

A fourth object of the present invention is to provide a light-sensitive material having less fluctuation in the photographic performances of a processing solution and excellent sharpness and color reproducibility even in processing with less replenishing amount of a color developing solution.

The above objects of the present invention have been achieved by the following light-sensitive material: that is, a silver halide color light-sensitive material comprising a support, and provided thereon at least one red-sensitive emulsion layer, at least one green-sensitive emulsion layer, and at least one blue-sensitive emulsion layer, and containing a coupler represented by the following Formula (I) and a coupler represented by the following Formula (II): Formula (I)

$$A_1\text{–(TIME)}_a\text{–}DI$$

Formula (II)

$$A_2\text{–(TIME)}_a\text{–}DI$$

wherein $A_1$ represents a group having an anti-diffusion group and releasing $(TIME)_a$–DI upon a reaction with an oxidation product of an aromatic primary amine developing agent; $A_2$ represents a group having no anti-diffusion group and releasing $(TIME)_a$–DI upon a reaction with an oxidation product of an aromatic primary amine developing agent; TIME represents a timing group which splits from DI after separating from A; DI represents a development inhibitor which is substantially deactivated after eluting into a developing solution; and a represents 1 or 2, and when a is 2, the two TIME's are the same or different.

DETAILED DESCRIPTION OF THE INVENTION

The compounds represented by Formulas (I) and (II) will be described below in detail.

$A_1$ and $A_2$ represent a coupler group, such as a coupler image forming group or a coupler group which does not substantially form a color image.

When $A_1$ and $A_2$ represent a yellow color image-forming coupler group, examples thereof include, for example, a pivaloylacetoanilide, a benzoylacetoanilide, a malonic ester, a carbamoylacetoamide, a malonic ester monoamide, a benzimidazlylacetoamide, or a cycloalkanoylacetoamide group. Further, they may be the coupler groups described in U.S. Pat. Nos. 5,021,332 and 5,021,330, or European Patent 421221A.

When $A_1$ and $A_2$ represent a magenta-forming coupler group, examples thereof include, for example, a 5-pyrazolone, a pyrazolobenzimidazote, a pyrazolotriazole, a pyrazoloimidazole, or a cyanoacetophenone group.

When $A_1$ and $A_2$ represent a cyan color image-forming coupler group, examples thereof include, for example, a phenol or a naphthol group. Further they may be the coupler groups described in U.S. Pat. No. 4,746,602, and EP-A-249453.

Further, $A_1$ and $A_2$ may be a coupler group which does not substantially leave a color image. There can be enumerated as coupler groups of this type, for example, an indanone coupler group and an acetophenone coupler group, and an eluting coupler group described in EP-A-443530 or EP-A-444501.

In Formulas (I) and (II), a preferred example of $A_1$ and $A_2$ is a coupler group represented by (Cp-1), (Cp-2), (Cp-3), (Cp-4), (Cp-5), (Cp-6), (Cp-7), (Cp-8), (Cp-9), or (Cp-10). These couplers are preferred since they have a fast coupling speed.;

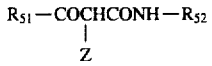

Formula (Cp-1)

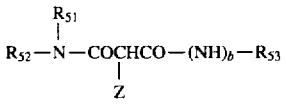

Formula (Cp-2)

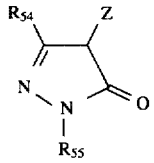

Formula (Cp-3)

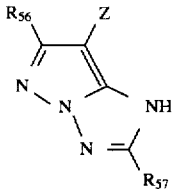

Formula (Cp-4)

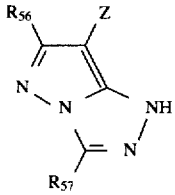

Formula (Cp-5)

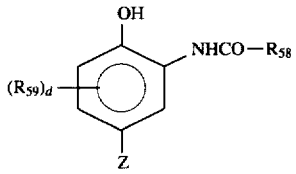

Formula (Cp-6)

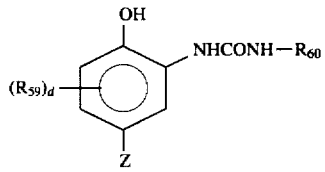

Formula (Cp-7)

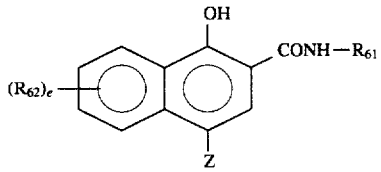

Formula (Cp-8)

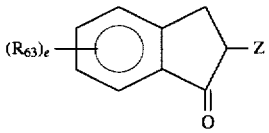

Formula (Cp-9)

-continued

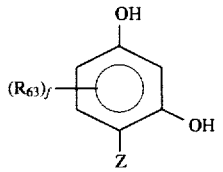

Formula (Cp-10)

In the above formulas, a free bond present at a coupling site represents the bonding position of a coupling elimination group.

When the coupler group is $A_1$ in the above formulas (Cp-1) to (Cp-10), at least one of $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, or $R_{63}$ contains an anti-diffusion group, and it is selected so that the sum of the carbon number in $R_{51}$ to $R_{63}$ is 8 to 40, preferably 10 to 30. In case of a coupler of a bis type, a telomer type, or a polymer type, any of the above substituents can represent a divalent group to form a repetitive unit. In this case, the carbon number may be outside of the above range.

The anti-diffusion group means a group which increases the molecular weight of the compound sufficiently to allow a molecule of the compound to be immobilized to the layer to which it is added.

When the coupler group is $A_2$ in the above formulas (Cp-1) to (Cp-10), it is selected so that the sum of the carbon number contained in $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, or $R_{63}$ is 0 to 15, preferably 0 to 10.

$R_{51}$ to $R_{63}$, b, d, e, and f will be explained below in detail. In the following, $R_{41}$ represents an alkyl group, an aryl group, or a heterocyclic group; $R_{42}$ represents an aryl group or a heterocyclic group, and $R_{43}$, $R_{44}$ and $R_{45}$ each represents a hydrogen atom, an alkyl group, an aryl group, or a heterocyclic group.

$R_{51}$ has the same meaning as $R_{41}$. $R_{52}$ and $R_{53}$ each have the same meaning as $R_{43}$. b represents 0 or 1. $R_{54}$ represents a group which has the same meaning as $R_{41}$, a $R_{41}CO(R_{43})N$— group, a $R_{41}SO_2(R_{43})N$— group, a $R_{41}(R_{43})N$— group, a $R_{41}S$— group, a $R_{43}O$— group, or a $R_{45}(R_{43})NCON(R_{44})$— group.

$R_{55}$ represents a group which has the same meaning as $R_{41}$. $R_{56}$ and $R_{57}$ each represents a group which has the same meaning as $R_{43}$, a $R_{41}S$— group, a $R_{43}O$— group a $R_{41}CO(R_{43})N$— group, or a $R_{41}SO_2(R_{43})N$— group. $R_{58}$ represents a group which has the same meaning as $R_{41}$. $R_{59}$ represents a group which has the same meaning as $R_{41}$, a $R_{41}CO(R_{43})N$— group, a $R_{41}OCO(R_{43})N$— group, a $R_{41}SO_2(R_{43})N$— group, a $R_{43}(R_{44})NCO(R_{45})N$— group, a $R_{41}O$— group, a $R_{41}S$— group, a halogen atom, or a $R_{41}(R_{43})N$— group. d represents 0 to 3. When d is plural, a plurality of $R_{59}$ represents the same groups or different groups. $R_{60}$ represents a group which has the same meaning as $R_{43}$. $R_{61}$ represents a group which has the same meaning as $R_{43}$. $R_{62}$ represents a group which has the same meaning as $R_{41}$, a $R_{41}CONH$— group, a $R_{41}O$ CONH— group, a $R_{41}SO_2NH$— group, a $R_{43}(R_{44})NCONH$— group, a $R_{43}(R_{44})NSO_2NH$— group, a $R_{43}O$— group, a $R_{41}S$— group, a halogen atom, or a $R_{41}NH$— group. $R_{63}$ represents a group which has the same meaning as $R_{41}$, a $R_{43}CO(R_{44})N$— group, a $R_{43}(R_{44})NCO$— group, a $R_{41}SO_2(R_{43})N$— group, a $R_{41}(R_{43})NSO_2$— group, a $R_{41}SO_2$— group, a $R_{43}OCO$— group, a halogen atom, a nitro group, a cyano group, or a $R_{43}CO$— group. e represents an integer of 0 to 4. When a plurality of $R_{62}$ or $R_{63}$ is present in (Cp-9), they each represents the same ones or different ones. f represents an integer of 0 to 3. When a plurality of $R_{63}$ is present in (Cp-10), they each represents the same ones or different ones.

When the coupler group is $A_1$ in the above formulas, the definitions of an alkyl group, an aryl group and a heterocyclic group are explained as follows.

The alkyl group is a saturated or unsaturated, chain or cyclic, linear or branched, substituted or unsubstituted alkyl group having a carbon number of 1 to 32, preferably 1 to 22. There can be enumerated as representative examples thereof, methyl, cyclopropyl, isopropyl, n-butyl, t-butyl, i-butyl, t-amyl, cyclohexyl, 2-ethylhexyl, 1,1,3,3-tetramethylbutyl, n-dodecyl, n-hexadecyl, or n-octadecyl.

The aryl group is that having 6 to 20 carbon atoms, and preferably a substituted or unsubstituted phenyl or a substituted or unsubstituted naphthyl.

The heterocyclic group is that having 1 to 20 carbon atoms, preferably 1 to 7 carbon atoms, and preferably a 3-membered to 8-membered, substituted or unsubstituted heterocyclic group and containing a hetero atom selected from a nitrogen atom, an oxygen atom or a sulfur atom. There can be enumerated as representative examples of the heterocyclic group, 2-imidazolyl, 2-benzimidazolyl, morpholino, pyrrolidino, 1,2,4-triazole-2-yl, or 1-indolinyl.

When the above alkyl group, aryl group and heterocyclic group have substituents, there can be enumerated as representative examples of the substituents, a halogen atom, a $R_{47}O$— group, a $R_{46}S$— group, a $R_{47}CO(R_{48})N$— group, a $R_{47}(R_{48})NCO$— group, a $R_{45}SO_2(R_{47})N$— group, a $R_{47}(R_{48})NSO_2$— group, a $R_{45}SO_2$— group, a $R_{47}OCO$— group, a $R_{47}CONHSO_2$— group, a $R_{47}(R_{48})NCONHSO_2$— group, a group which has the same meaning as $R_{46}$, a $R_{47}(R_{48})N$— group, a $R_{45}COO$— group, a cyano group, or a nitro group, wherein $R_{45}$ represents an alkyl group, an aryl group, or a heterocyclic group, and $R_{47}$ and $R_{48}$ each represents an alkyl group, an aryl group, a heterocyclic group, or a hydrogen atom. The definitions of the alkyl group, aryl group and heterocyclic group in $R_{45}$, $R_{47}$ and $R_{48}$ are the same as those defined previously.

When the coupler group is $A_2$ in the above formulas, the definitions of an alkyl group, an aryl group and a heterocyclic group are explained as follows.

The alkyl group is a saturated or unsaturated, chain or cyclic, linear or branched, substituted or unsubstituted alkyl group having a carbon number of 1 to 12, preferably 1 to 8. There can be enumerated as representative examples thereof, methyl, cyclopropyl, isopropyl, n-butyl, t-butyl, i-butyl, t-amyl, cyclohexyl, 2-ethylhexyl, or 1,1,3,3-tetramethylbutyl.

The aryl group is that having 6 to 20 carbon atoms, and preferably a substituted or unsubstituted phenyl.

The heterocyclic group is that having a carbon number of 1 to 10, preferably 1 to 5 and containing a hetero atom selected from a nitrogen atom, an oxygen atom or a sulfur atom and preferably a 3-membered to 8-membered, substituted or unsubstituted heterocyclic group. There can be enumerated as representative examples of the heterocyclic group, 2-imidazolyl, 2-benzimidazolyl, morpholino, pyrrolidino, 1,2,4-triazole-2-yl, or 1-indolinyl.

When the above alkyl group, aryl group and heterocyclic group have substituents, there can be enumerated as representative examples of the substituents, a halogen atom, a $R_{47}O$— group, a $R_{46}S$— group, a $R_{47}CO(R_{48})N$— group, a $R_{47}(R_{48})NCO$— group, a $R_{46}SO_2(R_{47})N$— group, a $R_{47}(R_{48})NSO_2$— group, a $R_{46}SO_2$— group, a $R_{47}OCO$— group, a $R_{47}CONHSO_2$— group, a $R_{47}(R_{48})NCONHSO_2$— group, a group which has the same meaning as $R_{48}$, a $R_{47}(R_{48})N$— group, a $R_{46}COO$— group, a cyano group, or a nitro group, wherein $R_{46}$ represents an alkyl group, an aryl group, or a heterocyclic group, and $R_{47}$ and $R_{48}$ each represents an alkyl group, an aryl group, a heterocyclic group, or a hydrogen atom. The definitions of the alkyl group, aryl group and heterocyclic group for $R_{46}$, $R_{47}$ and $R_{48}$ are the same as those defined previously.

Next, the development inhibitor represented by DI will be explained below.

The development inhibitor represented by DI includes, for example, the development inhibitors described U.S. Pat. Nos. 4,477,563, 5,021,331, 4,937,179, and 5,004,677, and European Patent Publications (EP) 336411A, 436190A, 440466A, 446863A, 447921A, 451526A, 458315A, 481422A, and 488310A. It includes particularly preferably tetrazolylthio, 1,3,4-oxadiazolylthio, 1,3,4-thiadiazolylthio, 1-(or 2-)benzotriazolyl, 1,2,4-triazole-1-(or 4-)yl, 1,2,3-triazole-1yl, 1-(or 2-)tetrazolyl, 2-benzothiazolylthio, 2-benzimidazolylthio, and substituted compounds thereof.

DI shows a development inhibiting action after splitting from $(TIME)_a$ and during processing a part thereof is eluted from a photographic layer to a developing solution. DI eluted in the developing solution is decomposed to substantially loose its development inhibiting action. The decomposition speed thereof is 30 seconds to 2 hours, preferably 2 minutes to 1 hour in terms of a half life. An alkali hydrolysis, a decomposition by a reaction with a chemical species (hydroxylamine and others) contained in a developer, or a deactivation by a substitution reaction of an adsorbing group (a mercapto group contained in DI) is representative as a decomposition reaction. Particularly preferred is the case in which at least one of the substituents contained in DI has an ester bond. For example, the following examples can be enumerated as DI:

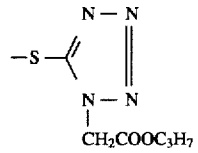

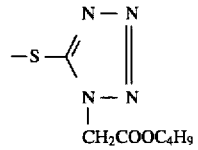

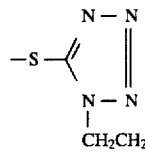

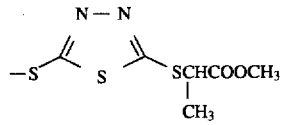

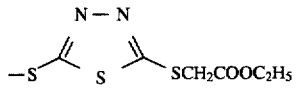

-continued

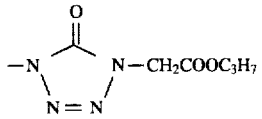

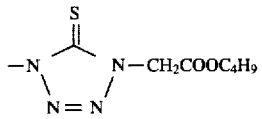

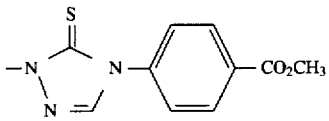

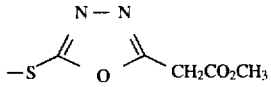

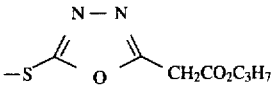

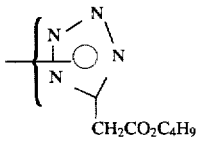

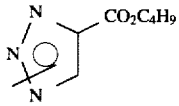

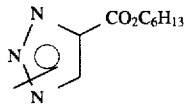

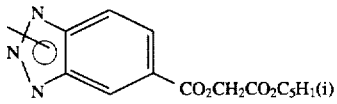

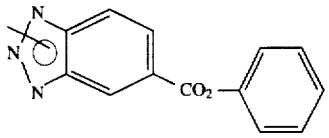

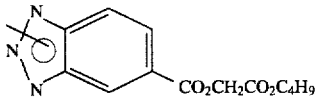

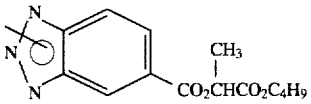

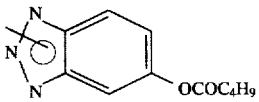

-continued

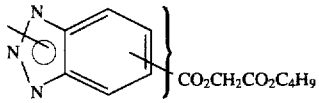

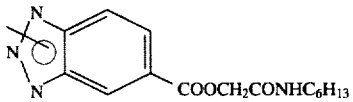

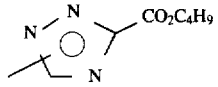

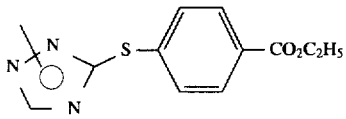

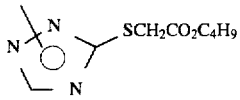

Next, the group represented by TIME will be explained below.

The group represented by TIME may be anyone as long as it is a group capable of splitting from DI after splitting from $A_1$ or $A_2$ in a development processing. There can be enumerated, for example, a group utilizing a cleavage reaction of hemiacetal, described in U.S. Pat. Nos. 4,146,396, 4,652,516, and 4,698,297; a timing group causing a cleavage reaction by utilizing an intermolecular nucleophilic substitution reaction, described in U.S. Pat. Nos. 4,248,962, 4,847,185, 4,912,028, and 4,857,440; a timing group causing a cleavage reaction by utilizing an electron transfer reaction, described in U. S. Pat. Nos. 4,409,323, 5,034,311, 5,055,385, and 4,421,845; a group causing a cleavage reaction by utilizing the hydrolysis reaction of iminoketal, described in U.S. Pat. No. 4,546,073; and a group causing a cleavage reaction by utilizing a hydrolysis reaction of ester, described in GP-A-2626317. There can be enumerated as an example in which two TIME's are combined (when a in Formula (I) or (II) is 2), the timing groups described in U.S. Pat. Nos. 4,861,701, 5,026,628, and 5,021,322, EP-A-499279 and EP-A-438129. TIME may be a timing group releasing two DI's, and the timing group described in EP-A-464612 can be enumerated as the example thereof. TIME is bonded to $A_1$ or $A_2$ via a hetero atom contained in TIME, preferably an oxygen atom, a sulfur atom or a nitrogen atom.

Preferred is the case in which at least one of the TIME's used in Formula (II) contains an anti-diffusion group. In this case, TIME contains a substituent having a total carbon number of 8 to 40, preferably 10 to 22.

The following Formula (T-1), (T-2) or (T-3) can be enumerated as preferred TIME:

$$*—W—(X{=}Y)_j—C(R_{21})R_{22}—** \qquad \text{Formula (T-1)}$$

$$*—W—CO—** \qquad \text{Formula (T-2)}$$

$$*—W—LINK—E—** \qquad \text{Formula (T-3)}$$

In the above formulas, * represents the position for bonding to $A_1$ or $A_2$ in Formula (I) or (II); ** represents the position for bonding to DI or TIME (when a is plural); W represents an oxygen atom, a sulfur atom, or $=N-R_{23}$; X and Y each represents a substituted or unsubstituted methine group or a nitrogen atom; j represents 0, 1 or 2; and $R_{21}$, $R_{22}$ and $R_{23}$ each represents a hydrogen atom or a substituent, wherein when X and Y represent a substituted methine, there may be either the case in which a cyclic structure is formed by a combination of any of the substituents of the substituted methine, $R_{21}$, $R_{22}$ and $R_{23}$ (for example, a benzene ring or a pyrazole ring), or the case in which such the cyclic structure is not formed. In Formula (T-3), E represents an electrophilic group, and LINK represents a linkage group sterically linking W and E so that they can be subjected to an intermolecular nucleophilic substitution reaction. Most preferred as TIME is that represented by Formula (T-1). Specific examples are, for example, the following ones:

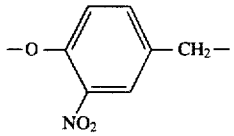

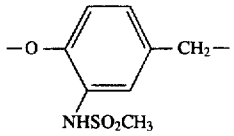

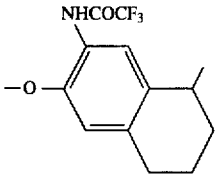

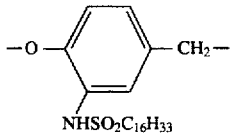

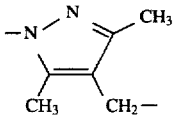

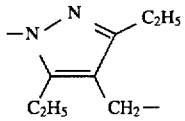

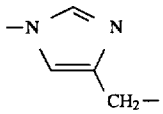

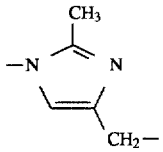

-continued

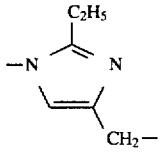

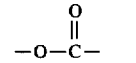

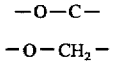

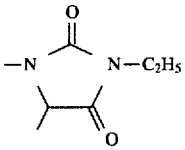

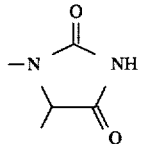

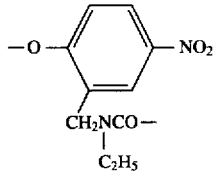

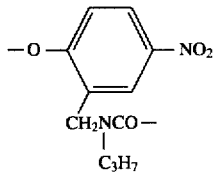

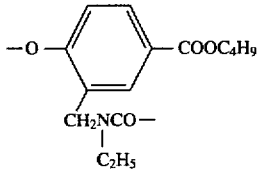

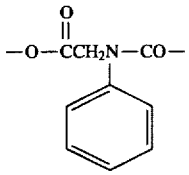

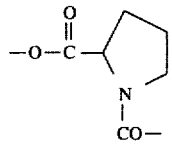

-continued
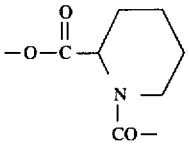
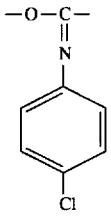
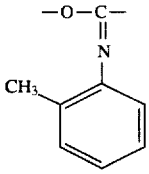
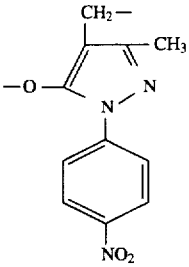
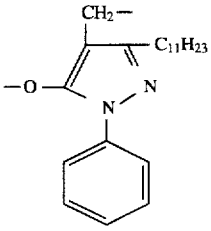
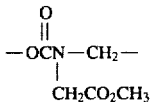
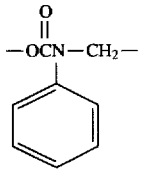
-continued
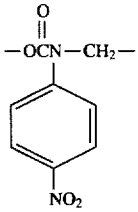
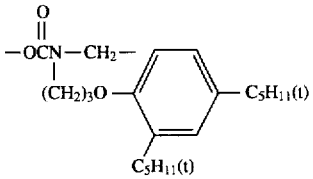
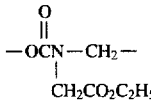
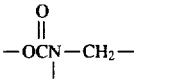
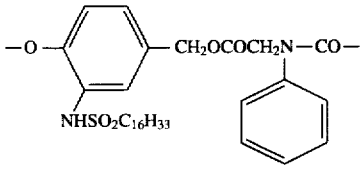
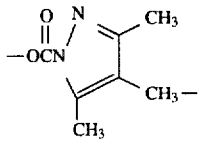
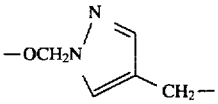
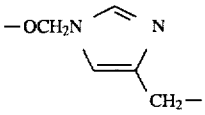
Specific representative examples of the coupler used in the present invention represented by Formula (I) will be shown below, but the present invention is not limited thereto:
D-1
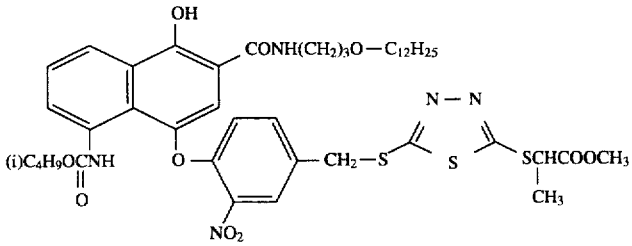

-continued
D-2
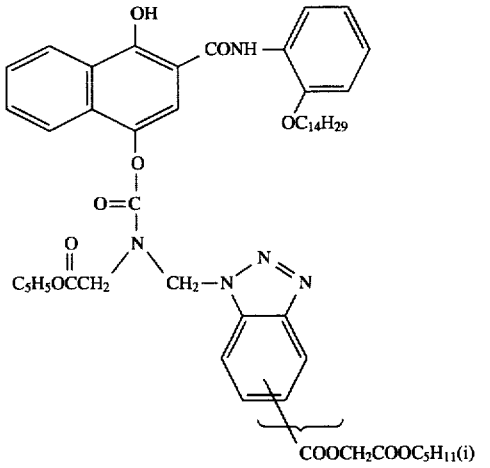
D-3
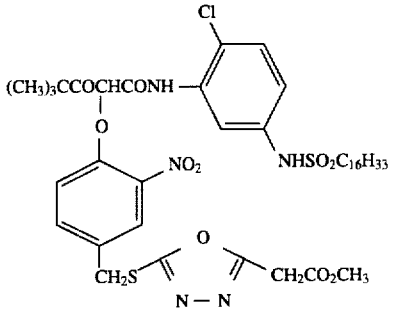
D-4
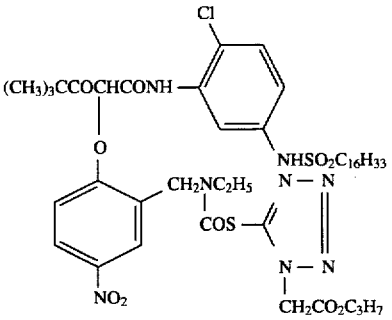
D-5
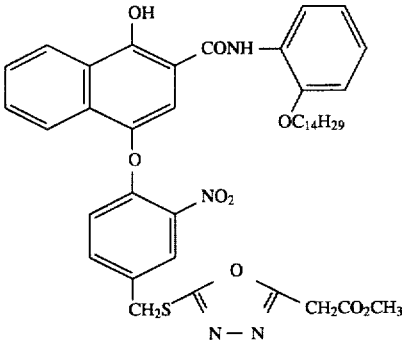
D-6
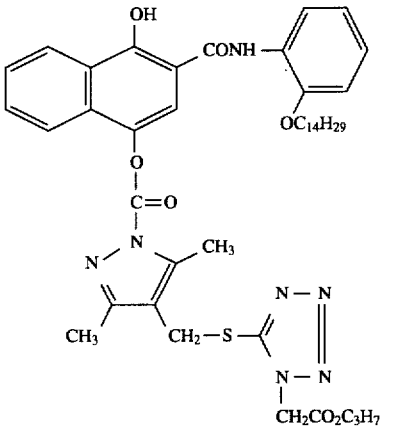
D-7
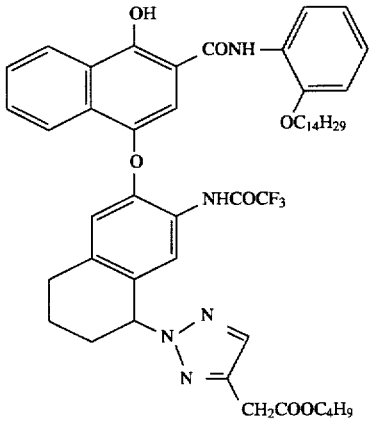
D-8
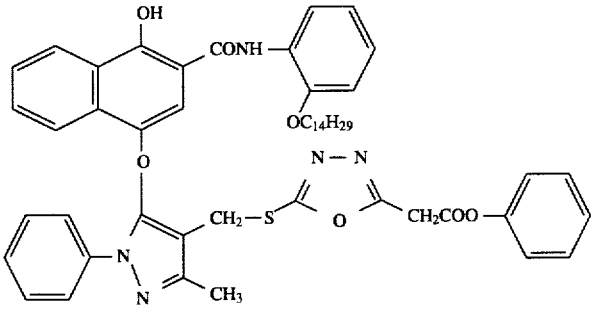

-continued
D-9
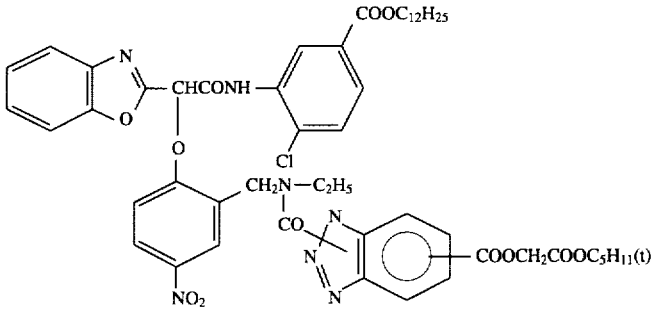
D-10
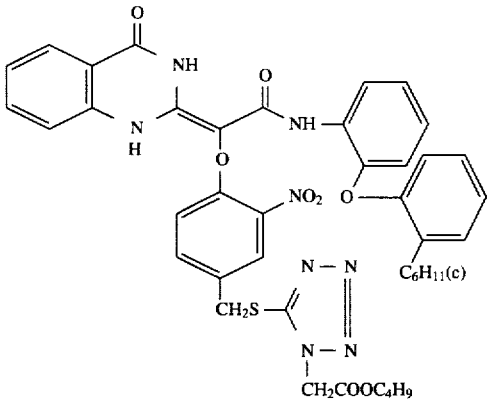
D-11
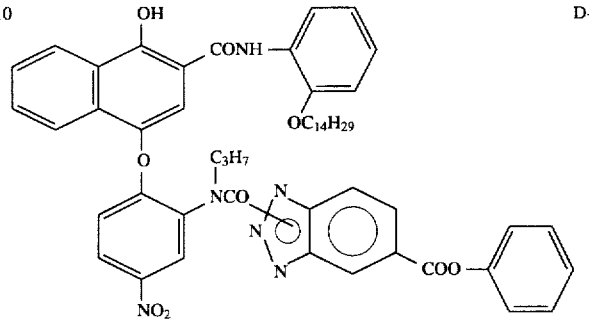
D-12
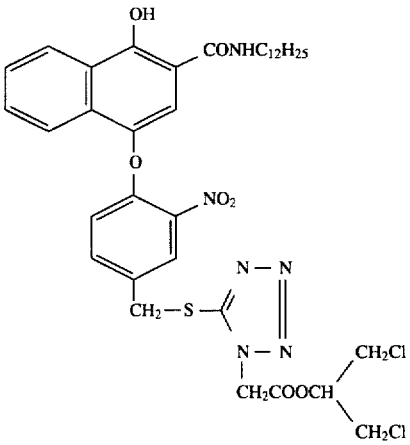
D-13
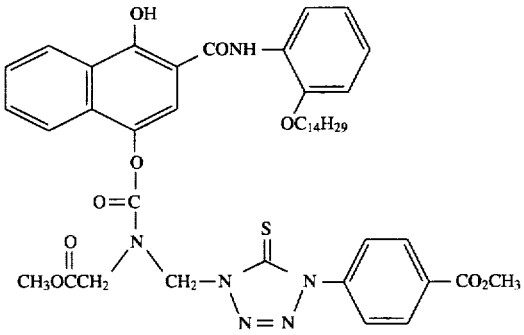
D-14
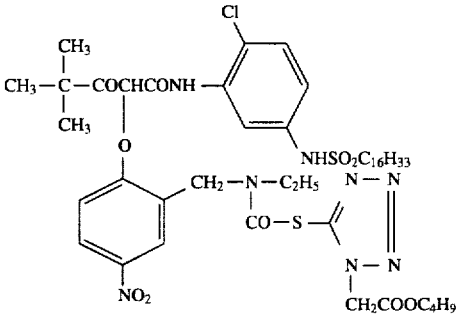
D-15
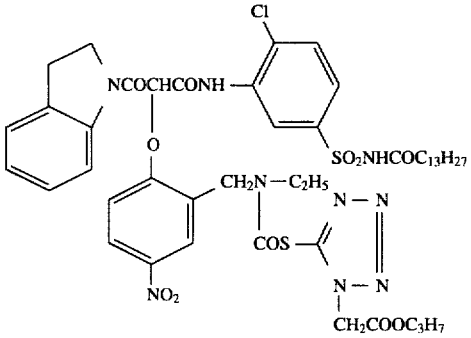

-continued
D-16
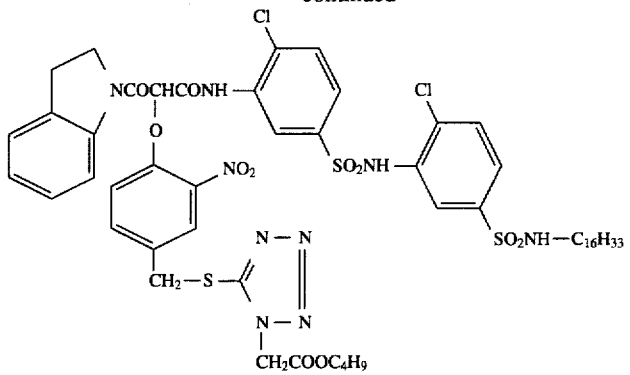
D-17
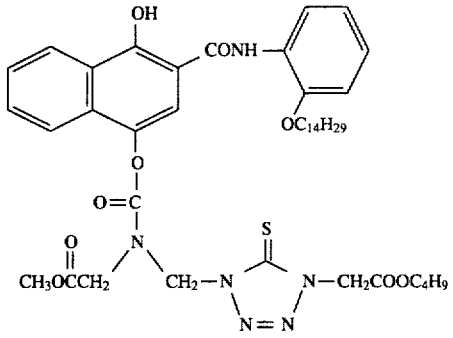
D-18
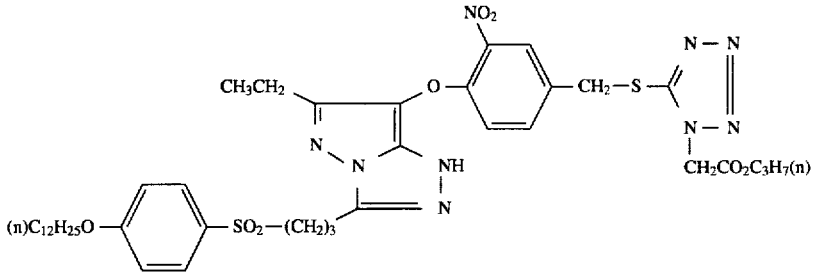
D-19
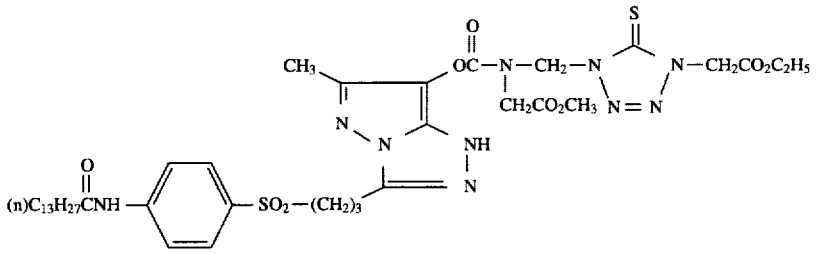
D-20
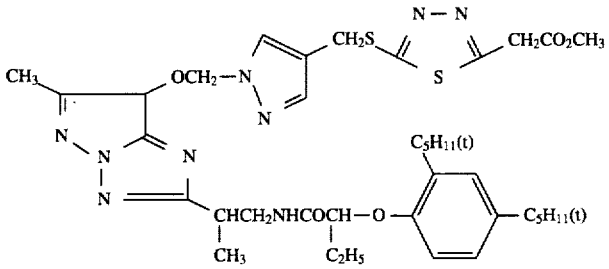
Next, specific examples of the coupler represented by Formula (II) will be shown below, but the present invention is not limited thereto:

E-1
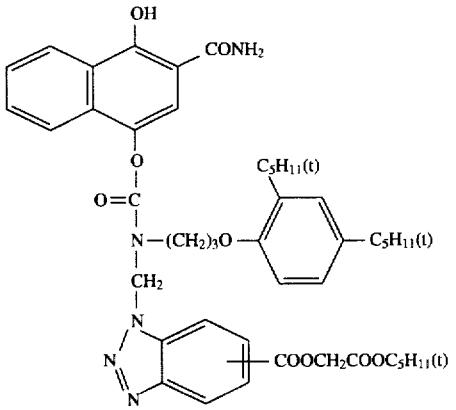
E-2
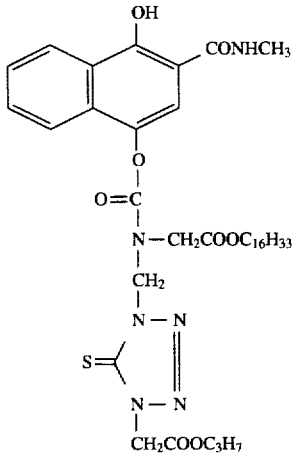
E-3
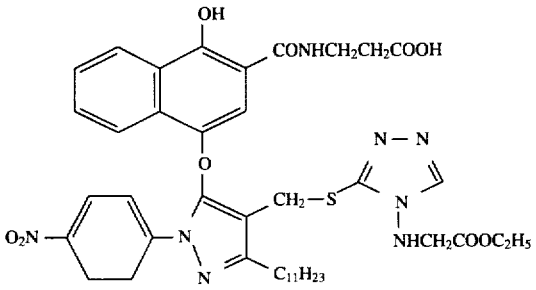
E-4
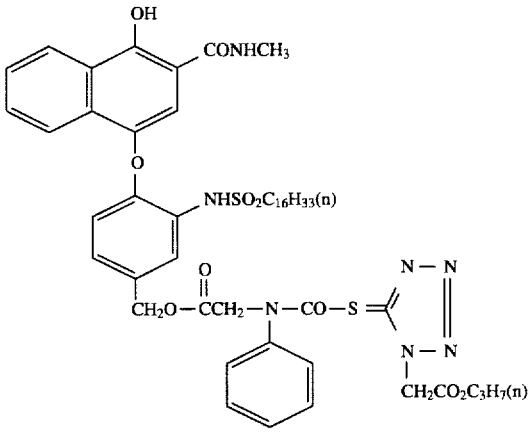
E-5
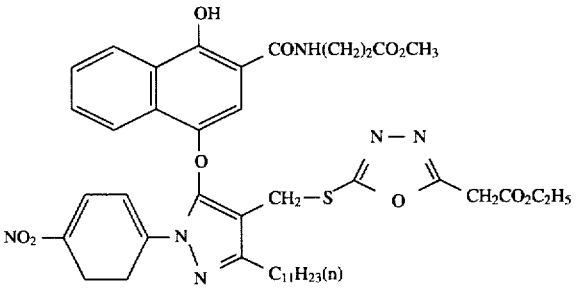
E-6
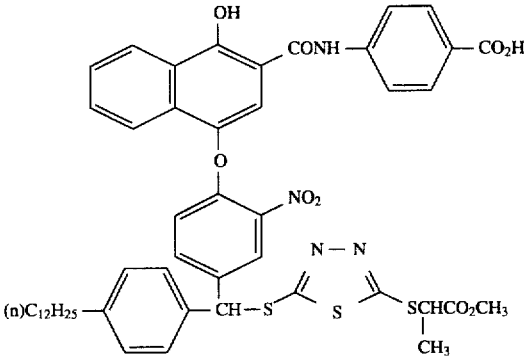

-continued
E-7
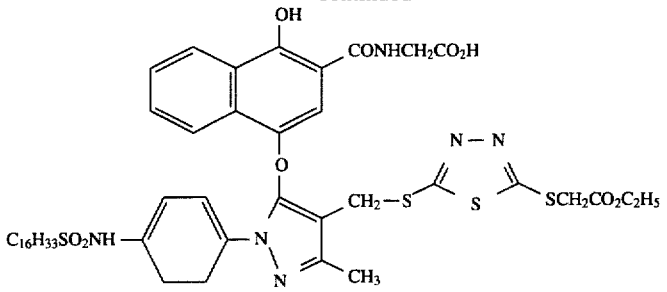
E-8
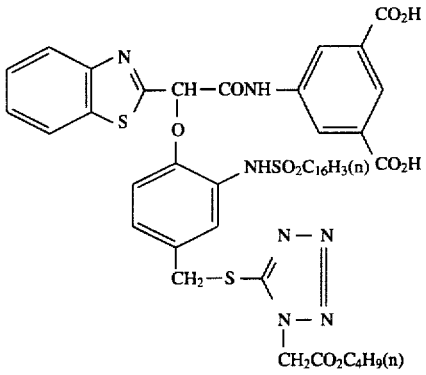
E-9
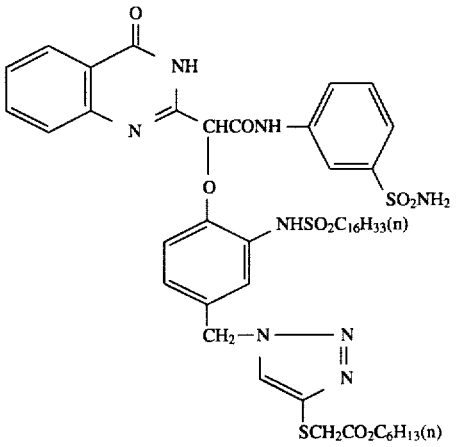
E-10
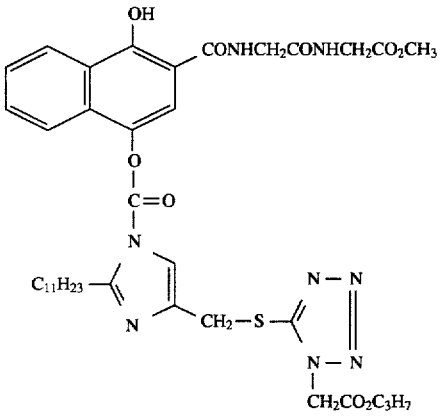
E-11
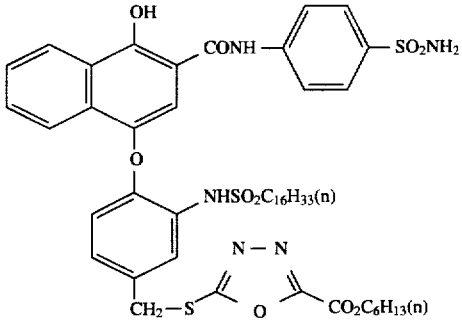
E-12
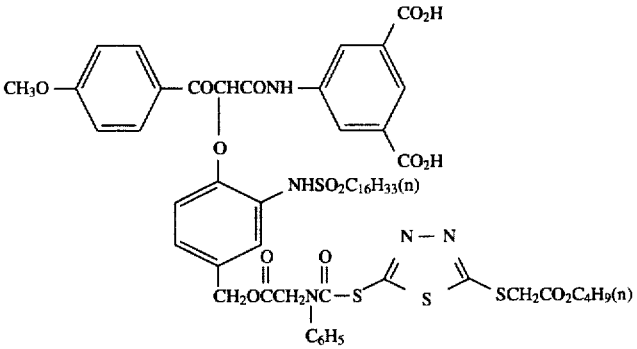

-continued

E-13

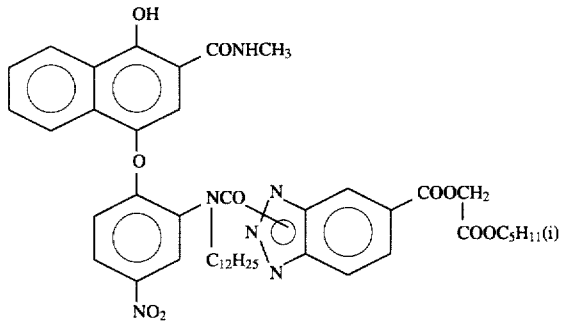

E-14

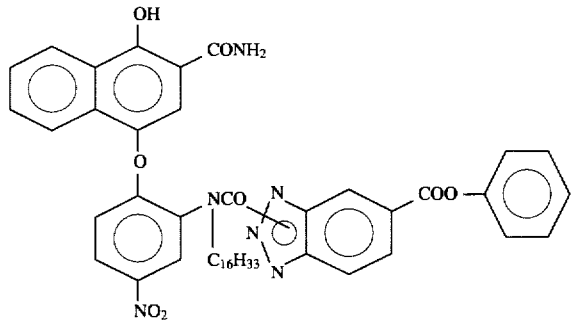

E-15

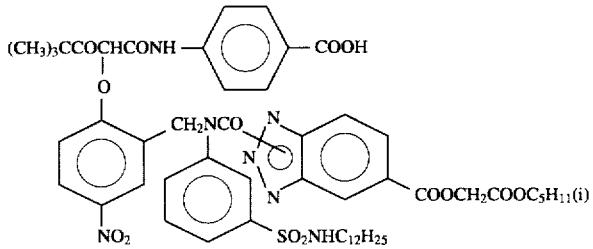

The couplers represented by Formula (I) and Formula (II) can be synthesized according to the methods described in U.S. Pat. No. 4,782,012, and JP-A-57-151944, JP-A-58-162949, JP-A-60-128444, JP-A-63-37350, JP-A-3-198048, JP-A-3-228048, JP-A-4-251843, JP-A-4-278942, JP-A-4-279943, JP-A-4-280247, and JP-A-313750, and the methods described in the literatures and patents cited therein.

The couplers represented by Formula (I) and Formula (II) can be emulsified and dispersed by the same method as that applied to a conventional coupler, which will be described later and then can be added to a light-sensitive material. The coupler represented by Formula (I) is added preferably to an infrared-sensitive emulsion layer. $A_1$ of Formula is represented preferably by (Cp-6), (Cp-7) and (Cp-8), and (Cp-8) is particularly preferred.

The coupler represented by Formula (II) is added preferably to a green-sensitive emulsion layer and/or a blue-sensitive emulsion layer.

The addition amounts of the couplers represented by Formula (I) and Formula (II) each are $1.0\times10^{-5}$ to 0.30 g/m$^2$, preferably $1.0\times10^{-4}$ to 0.20 g/m$^2$, and more preferably $1.0\times10^{-3}$ to 0.10 g/m$^2$ of the photographic material.

The light-sensitive material of the present invention may comprise on a support at least one blue-sensitive silver halide emulsion layer, at least one green-sensitive silver halide emulsion layer and at least one red-sensitive silver halide emulsion layer, and there are specifically no limits to the number and order of the silver halide emulsion layers and non-light-sensitive layers.

One typical example is a silver halide photographic light-sensitive material having on a support at least one light-sensitive layer unit comprising a plurality of the silver halide emulsion layers having substantially the same color sensitivity but different photographic speeds, wherein the light-sensitive layer unit has a spectral sensitivity to any of blue light, green light and red light. In a multi-layer silver halide color photographic light-sensitive material, the light-sensitive layer units are usually provided in the order of a red-sensitive layer unit, a green-sensitive layer unit and a blue-sensitive layer unit from the support side. According to purposes, however, the above order may be different, or there can be taken an arrangement order in which a layer having a different light sensitivity is interposed between the layers having the same color sensitivity.

Various non-light-sensitive layers such as an intermediate layer may be provided between the above silver halide light-sensitive layers and on the uppermost layer or lowest layer.

The above intermediate layer may contain the couplers and DIR compounds described in JP-A-61-43748, JP-A-59-113438, JP-A-59-113440, JP-A-61-20037, and JP-A-61-20038 and may further contain an anti-color mixing agent as usually used.

In the plural silver halide emulsion layers constituting the respective light-sensitive layer units, there can preferably be used a two layer structure consisting of a high-speed emulsion layer and a low-speed emulsion layer, as described in German Patent 1,121,470 or British Patent 923,045. Usually, they are preferably provided so that the speeds become lower in order to the support. A non-light-sensitive layer may be provided between the respective silver halide emulsion layers. Further, a low-speed layer may be provided on the side farther from the support and a high-speed layer may be provided on the side closer to the support, as described in JP-A-57-112751, JP-A-62-200350, JP-A-62-206541, and JP-A-62-206543.

There can be provided as a specific example thereof, the layers from the side farthest from the support in the order of a low-speed blue-sensitive layer (BL)/a high-speed blue-sensitive layer (BH)/a high-speed green-sensitive layer (GH)/a low-speed green-sensitive layer (GL)/a high-speed red-sensitive layer (RH)/a low-speed red-sensitive layer (RL), or the order of BH/BL/GL/GH/RH/RL, or the order of BH/BL/GH/GL/RL/RH.

Further, the layers can be provided from the side farthest from the support in the order of a blue-sensitive layer/GH/RH/GL/RL, as described in JP-B-55-34932 (the term JP-B" as used herein means an examined Japanese patent publication). The layers can also be provided from the side farthest from the support in the order of a blue-sensitive layer/GL/RL/GH/RH, as described in JP-A-56-25738 and JP-A-62-63936.

Further, there can be enumerated the arrangement of three layers each having different speeds which are lowered in order toward a support, in which a highest speed light-sensitive silver halide emulsion layer is provided furthest from the support, a middle speed light-sensitive silver halide emulsion layer having a lower speed than the highest speed emulsion layer, and a low speed light-sensitive silver halide emulsion layer having a further lower speed than that of the intermediate layer is provided closest to the support, as described in JP-B-49-15495. Also, in the case where the layers are composed of such three layers as having different speeds, the layers having the same color sensitivity may be provided from the side farthest from the support in the order of a middle speed light-sensitive emulsion layer/a high speed light-sensitive emulsion layer/a low speed light-sensitive layer, as described in JP-A-59-202464.

In addition to the above, the layers may be provided in the order of a high speed emulsion layer/a low speed emulsion layer/a middle speed emulsion layer, or the order of a low speed emulsion layer/a middle speed emulsion layer/a high speed emulsion layer. The layer arrangement may be changed as described above also in the case of four layers or more.

In order to improve color reproduction, a donor layer (CL) having an interlayer effect, which is different in spectral sensitivity distribution from the primary light-sensitive layers such as BL, GL and RL is preferably provided adjacent or close to the primary light-sensitive layers, as described in the specifications of U.S. Pat. Nos. 4,663,271, 4,705,744, and 4,707,436, and JP-A-62-160448 and JP-A-63-89850.

As described above, various layer structures and arrangements can be selected according to the purposes of the respective light-sensitive materials.

A preferred silver halide contained in the light-sensitive material used in the present invention is silver bromoiodide, silver chloroiodide or silver bromochloroiodide each containing about 30 mole % or less of silver iodide. Particularly preferred is silver bromoiodide or silver bromochloroiodide each containing up to about 2 to about 10 mole % of silver iodide.

The silver halide grains contained in a photographic emulsion may have a regular crystal structure, such as a cubic, octahedral or tetradecahedral structure, an irregular crystal structure, such as a spherical or tabular structure, a defective crystal structure such as a twinned crystal, or a composite form thereof.

The silver halide may comprise fine grains having a grain size (defined as the diameter of a circle having the same area as the projected area of the grain and being a number average) of about 0.2 μm or less, or large grains having a grain size (defined as above) of up to about 10 μm. The silver halide emulsion may be either polydispersed or monodispersed.

The silver halide photographic emulsion which can be used in the present invention can be prepared by the methods described in, for example, *Research Disclosure* (RD) No. 17643 (December 1978), pp. 22–23, "I. Emulsion Preparation and Types"; *Research Disclosure* No. 18716 (November 1979), p. 648; *Research Disclosure* No. 307105 (November 1989), pp. 863–865; *Chimie et Physique Photographique*, written by P. Glafkides, published by Paul Montel Co. (1967); *Photographic Emulsion Chemistry*, written by G. F. Duffin, published by Focal Press Co. (1966); and *Making and Coating Photographic Emulsions*, written by V. L. Zelikman et al, published by Focal Press Co. (1964).

Preferred are the monodispersed emulsions described in U.S. Pat. Nos. 3,574,628 and 3,655,394, and British Patent 1,413,748.

Tabular grains having an aspect ratio of 3 or more can be used in the present invention. The tabular grains can readily be prepared by the methods described in *Photographic Science and Engineering*, written by Gutoff, vol. 14, pp. 248–257 (1970), U.S. Pat. Nos. 4,434,226, 4,414,310, 4,433,048, and 4,439,520, and British Patent 2,112,157.

The crystal structure may be uniform, or of a structure in which the halogen composition is different in the interior and the surface of the grains, or of a stratum structure. Further, silver halides of different compositions may be joined with an epitaxial junction. Also, it may be of a structure in which silver halide is joined with compounds other than silver halide, for example, silver rhodanide and lead oxide. Further, a mixture of grains having different crystal forms may be used.

The above emulsion+may be of any of a surface latent image type in which a latent image is formed primarily on the surface of a grain, an internal latent image type in which a latent image is formed primarily in the inside of the grain, or a type in which latent images are formed either on a surface or in the inside of the grain. The emulsion is required to be of a negative type. Of the emulsions of the internal latent image type, the emulsion may be a core/shell type internal latent image type emulsion described in JP-A-3-264740. A method for preparing this core/shell internal latent image type emulsion is described in JP-A-59-133542. The thickness of the shell of this emulsion can be varied according to the development processing which is to be employed and other parameters. It is preferably 3 to 40 nm, particularly preferably 5 to 20 nm.

Usually, the silver halide emulsions are subjected to physical ripening, chemical ripening and spectral sensitization before using. The additives used in such processes are described in *Research Disclosure*, No. 17643, No. 18716 and No.307105, and the corresponding portions are summarized in the table shown later.

In the light-sensitive material of the present invention, there can be mixed and used in the same layer, emulsions of two or more kinds each having at least one different characteristic of grain size, grain size distribution, halogen composition, grain form, or sensitivity in a light-sensitive silver halide emulsion.

There can be preferably used silver halide grains in which the surfaces thereof are fogged, such as described in U.S. Pat. No. 4,082,553, silver halide grains in which the insides thereof are fogged, such as described in U.S. Pat. No. 4,626,498 and JP-A-59-214852, and colloidal silver for a light-sensitive silver halide emulsion and/or a substantially non-light-sensitive hydrophilic colloid layer. The silver halide grains in which the insides or surfaces thereof are fogged are defined by silver halide grains which can be uniformly (non-imagewise) developed regardless of an unexposed portion and an exposed portion in a light-sensitive material. The methods for preparing the silver halide grains in which the insides or surfaces thereof are fogged are described in U.S. Pat. No. 4,626,498 and JP-A-59-214852.

The silver halide constituting the inner nucleus of a core/shell type silver halide grain in which the inside thereof is fogged may be either of a uniform halogen composition or an ununiform halogen composition. Anyone of silver chloride, silver bromochloride, silver bromoiodide and silver bromochloroiodide can be used for the silver halide grains in which the insides or surfaces thereof are fogged. The grain size of these fogged silver halide grains is not specifically limited. The average grain size thereof is preferably 0.01 to 0.75 μm, particularly preferably 0.05 to 0.6 μm. Also, the grain form thereof is not specifically limited. It may be a regular grain or a polydispersed emulsion. It is preferably monodispersed (at least 95% by weight or by number of the silver halide grains have grain sizes falling within ±40% of an average grain size).

In the present invention, non-light-sensitive fine grain silver halide is preferably used. Non-light-sensitive fine grain silver halide is silver halide fine grains which are not sensitized during imagewise exposing for obtaining a dye image and substantially not developed in the development processing thereof, and they are preferably not fogged in advance.

The non-light-sensitive fine grain silver halide has a silver bromide content of 0 to 100 mole % and may contain silver chloride and/or silver iodide according to necessity. They contain preferably silver iodide of 0.5 to 10 mole %.

The non-light-sensitive fine grain silver halide has an average grain size (the average value of the diameter of a circle corresponding to the projected area of a grain) of preferably 0.01 to 0.5 μm, more preferably 0.02 to 0.2 μm.

The non-light-sensitive fine grain silver halide can be prepared by the same method as that for preparing conventional light-sensitive silver halide. In this case, the surfaces of the silver halide grains are required to be neither optically sensitized nor spectrally sensitized, provided that known stabilizers such as the triazole series, azaindene series, benzothiazolium series and mercapto series compounds and a zinc compound are preferably added to the grains in advance before adding the emulsion to a coating solution. Colloidal silver can be preferably incorporated into the layer containing this non-light-sensitive silver halide fine grain.

The amount of silver coated on the light-sensitive material of the present invention is preferably 6.0 g/m$^2$ or less, most preferably 4.5 g/m$^2$ or less.

Known photographic additives which can be used in the present invention are described in the above three *Research Disclosures*, and the corresponding portions described therein are shown in the following table.

| Kind of additives | RD 17643 | RD 18716 | RD 307105 |
|---|---|---|---|
| 1. Chemical sensitizer | p. 23 | p. 648, right colm. | p. 866 |
| 2. Sensitivity improver | — | p. 648, right colm. | |
| 3. Spectral sensitizer & super-sensitizer | pp. 23 to 24 | p. 648, right colm. to p. 649, right colm. | pp. 866 to 868 |
| 4. Whitening agent | p. 24 right colm. | p. 647, | p. 868 |
| 5. Anti-foggant & stabilizer | pp. 24 to 25 | p. 649, right colm. | pp. 868 to 870 |
| 6. Light absorber, filter dye, & UV absorber | pp. 25 to 26 | p. 649, right colm. to p. 650, left colm. | p. 873 |
| 7. Anti-stain agent | p. 25 right colm. | p. 650, left colmn. to right colm. | p. 872 |
| 8. Dye image stabilizer | p. 25 | p. 650, left colm. | p. 872 |
| 9. Hardener | p. 26 | p. 651, left colm. | pp. 874 to 875 |
| 10. Binder | p. 26 | p. 651, left colm. | pp. 873 to 874 |
| 11. Plasticizer & lubricant | p. 27 | p. 650, right colm. | p. 876 |
| 12. Coating aid & surfactant | pp. 26 to 27 | p. 650, right colm. | pp. 875 to 876 |
| 13. Anti-static agent | p. 27 | p. 650, right colm. | pp. 876 to 877 |
| 14. Matting agent | — | — | pp. 878 to 879 |

For the purpose of preventing the deterioration of the photographic performances attributable to formaldehyde gas, preferably added to a light-sensitive material are the compounds capable of reacting with formaldehyde to fix it, which are described in U.S. Pat. Nos. 4,411,987 and 4,435,503.

The mercapto compounds described in U.S. Pat. Nos. 4,740,454 and 4,788,132, and JP-A-62-18539 and JP-A-1-283551 are preferably incorporated into the light-sensitive material of the present invention.

Preferably incorporated into the light-sensitive material of the present invention is a compound capable of releasing a fogging agent, a development accelerator, a silver halide solvent or a precursor thereof, regardless of the amount of developed silver which is formed by development processing, described in JP-A-1-106052.

There are preferably incorporated into the light-sensitive material of the present invention, dyes dispersed by the methods described in International Patent Publication W088/04794 and JP=A-1-502912, or the dyes described in EP-A-317,308, U.S. Pat. No. 4,420,555, and JP-A-1-259358.

In the present invention, various color couplers can be used. Specific examples thereof are described in the patents abstracted in the above *Research Disclosure* No. 17643, VII-C to G and *Research Disclosure* No. 07105, VII-C to G.

Preferred as a yellow coupler are the compounds described in, for example, U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023 and 4,511,649, and EP-A-249,473.

The 5-pyrazolone and pyrazoloazole series compounds are preferred as a magenta coupler. Particularly preferred are the compounds described in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and International Patent Publication WO88/04795.

The phenol series and naphthol series couplers are examples of a cyan coupler which can be used in the present invention. Preferred are the compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, German Patent Publication 3,329,729, EP-A-121,365 and EP-A-249,453, U.S. Pat. Nos. 3,446,622, 4,333,999, 4,775,616, 4,451,559, 4,427,767, 4,690,889, 4,254,212, and 4,296,199, and JP-A-61-42658. Further, there can be used the pyrazoloazole series couplers described in JP-A-64-553, JP-A-64-554, JP-A-64-555, and JP-A-64-556, and the imidazole series couplers described in U.S. Pat. No. 4,818,672.

Typical examples of a polymerized dye-forming coupler are described in U.S. Pat. Nos. 3,451,820, 4,080,211, 4,367,282, 4,409,320, and 4,576,910, British Patent 2,102,173, and EP-A-341,188.

Preferred as a coupler capable of forming a dye having an appropriate dispersing property are the compounds described in U.S. Pat. No. 4,366,237, British Patent 2,125,570, European Patent 96,570, and German Patent (published) 3,234,533.

Preferred as a colored coupler used for correcting an undesired absorption of a developed dye are the compounds described in *Research Disclosure* No. 17643, Item VII-G and *Research Disclosure* No. 307105, Item VII-G, U.S. Pat. No. 4,163,670, JP-B-57-39413, U.S. Pat. Nos. 4,004,929 and 4,138,258, and British Patent 1,146,368. Also, preferably used are the couplers which correct the undesired absorption of a developed dye with a fluorescent dye released in coupling, described in U.S. Pat. No. 4,774,181, and couplers having as a releasing group a dye precursor group capable of reacting with a developing agent to form a dye, described in U.S. Pat. No. 4,777,120.

In the present invention, there can also be preferably used compounds releasing a photographically useful group upon coupling. Preferred as a DIR coupler releasing a development inhibitor are the compounds described in the patents abstracted in the above RD No. 17643, Item VII-F and No. 307105, Item VII-F, JP-A-57-151944, JP-A-57-154234, JP-A-60-184248, JP-A-63-37346, and JP-A-63-37350, U.S. Pat. Nos. 4,248,962 and 4,782,012.

The bleaching accelerator-releasing couplers described in RD No. 11449 and RD No. 24241, and JP-A-61-201247 are effective for shortening the time for a processing process having a bleaching ability and are effective particularly when they are added to a light-sensitive material in which the above tabular silver halide grains are used.

Preferred as a coupler releasing imagewise a nucleus-forming agent or a development accelerator during developing are the compounds described in British Patents 2,097,140 and 2,131,188, and JP-A-59-157638 and JP-A-59-170840. Also preferred are the compounds releasing a fogging agent, a development accelerator and a silver halide solvent upon an oxidation-reduction reaction with the oxidation product of a developing agent, described in JP-A-60-107029, JP-A-60-252340, JP-A-1-44940 and JP-A-1-45687.

In addition to the above, there can be enumerated as couplers capable of being used for the light-sensitive material of the present invention, the competitive couplers described in U.S. Pat. No. 4,130,427; the polyequivalent couplers described in U.S. Pat. Nos. 4,283,472, 4,338,393 and 4,310,618; the DIR redox compound-releasing couplers, DIR coupler-releasing couplers, DIR coupler-releasing redox compounds, or DIR redox-releasing redox compounds described in JP-A-60-185950 and JP-A-62-24252; the couplers releasing a dye whose color is recovered after splitting off, described in EP-A-173,302 and EP-A-313,308; the ligand-releasing couplers described in U.S. Pat. No. 4,555,477; the couplers releasing a leuco dye, described in JP-A-63-75747; and the couplers releasing a fluorescent dye, described in U.S. Pat. No. 4,774,181.

The couplers used in the present invention can be incorporated into a light-sensitive material by various conventional dispersing methods.

Examples of a high boiling-solvent used in an oil-in-water dispersion method are described in U.S. Pat. No. 2,322,027. Specific examples of the high boiling organic solvent which has a boiling point of 175° C. or higher at a normal pressure and is used in an oil-in-water dispersion method are phthalic acid esters (dibutyl phthalate, dicyclohexyl phthalate, di-2-ethyl-hexyl phthalate, decyl phthalate, bis(2,4-di-t-amylphenyl)phthalate, bis(2,4-di-6-amylphenyl)isophthalate, and bis(1,1-diethylpropyl)phthalate), phosphoric acid or phosphonic acid esters (triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate), benzoic acid esters (2-ethylhexyl benzoate, dodecyl benzoate, and 2-ethylhexyl-p-hydroxybenzoate), amides (N,N-diethyldodecanamide, N,N-diethyllaurylamide, and N-tetradecylpyrrolidone), alcohols or phenols (isostearyl alcohol and 2,4-di-tert-amylphenol), aliphatic carboxylic acid esters (bis(2-ethylhexyl)sebacate, dioctyl azelate, glycerol tributylate, isostearyl lactate, and trioctyl citrate), an aniline derivative (N,N-di-butyl-2-butoxy-5-tert-octylaniline), and hydrocarbons (paraffin, dodecylbenzene, and diisopropylnaphthalene). Further, there can be used as an auxiliary solvent, organic solvents having a boiling point of about 30° C. or higher, preferably 50° C. or higher and about 160° C. or lower. Typical examples thereof are ethyl acetate, butyl acetate, ethyl propionate, methyl ethyl ketone, cyclohexanone, 2-ethoxyethyl acetate, and dimethylformamide.

A latex dispersing method can be employed for dispersing the couplers. Specific examples of the processes and effects of a latex dispersing method and latexes for impregnation are described in U.S. Pat. No. 4,199,363, and German Patent Applications (OLS) 2,541,274 and 2,541,230.

Preferably incorporated into the light-sensitive material of the present invention are various preservatives and antimold agents such as phenethyl alcohol, and 1,2-benzisothiazoline-3-one, n-butyl p-hydroxybenzoate, phenol, 4-chloro-3,5-dimethylphenol, 2-phenoxyethanol, and 2-(4-thiazolyl) benzimidazole each described in JP-A-63-257747, JP-A-62-272248 and JP-A-1-80941.

The present invention can be applied to various light-sensitive materials. There can be enumerated as representative examples, a color negative film for general use or movie use, a color reversal film for a slide or television, a color paper, a color positive film, and a color reversal paper.

An appropriate support which can be used in the present invention is described in, for example, above RD No. 17643, p. 28, RD No. 18716, p. 647, right column to p. 648, left column, and RD No. 307105, p. 879.

In the light-sensitive material of the present invention, the total of the thicknesses of all the hydrophilic colloid layers provided on a support side having an emulsion layer is preferably 28 μm or less, more preferably 23 μm or less, further more preferably 18 μm or less, and particularly preferably 16 μm or less.

The layer swelling speed T½ is preferably 30 seconds or less, more preferably 20 seconds or less. The layer thickness means a layer thickness measured after standing at 25° C. and a relative humidity of 55% for two days. The layer swelling speed T½ can be measured according to the methods known in the art. For example, it can be measured with the swellometer of the type described in *Photographic Science and Engineering*, written by A. Green et al, vol. 19, No. 2, pp. 124–129, and T½ is defined as the time necessary to reach a half of a saturated layer thickness, in which the saturated layer thickness corresponds to 90% of the maximum swelling layer thickness attained when the layer is processed in a color developing solution at 30° C. for 3 minutes and 15 seconds.

The layer swelling speed T½ can be adjusted by adding a hardener to gelatin which acts as a binder or by changing the aging conditions after coating. The swelling ratio is preferably 150 to 400%, wherein the swelling ratio can be calculated from the maximum swollen layer thickness attained at the above mentioned conditions according to the following equation:

(maximum swollen layer thickness−layer thickness)÷layer thickness.

A hydrophilic colloid layer (hereinafter referred to as a back layer) having a total dry layer thicknesses of 2 to 20 μm is preferably provided on a support side opposite to the side having thereon an emulsion layer. Preferably incorporated into this back layer are the above light absorber, filter dye, UV absorber, anti-static agent, hardener, binder, plasticizer, lubricant, coating aid, and surface active agent. The swelling ratio of this back layer is preferably 150 to 500%.

The light-sensitive material according to the present invention can be subjected to development processing according to the conventional methods described in the above RD No. 17643, pp. 28–29, RD No. 18716, p. 651, left column to right column, and RD No. 307105, pp. 880–881.

The known aromatic primary amine color developing agents can be used as a color developing agent in a color developing solution.

The preferred color developing agent is a p-phenylenediamine compound, and there can enumerated as representative examples thereof:

D-1: 4-amino-3-methyl-N-ethyl-N-(β-hydroxyethyl)aniline

D-2: 4-amino-3-methyl-N-ethyl-N-[β-(methane-sulfonamide)ethyl]aniline

D-3: 4-amino-3-methyl-N-ethyl-N-(4-hydroxybutyl)aniline

D-4: 4-amino-3-methyl-N-ethyl-N-(3-hydroxypropyl)aniline, or, the color developing agent represented by Formula (I) in JP-A-4-443.

There can be used for a color developing solution as a compound directly preserving the above aromatic primary amine color developing agents, various hydroxylamines described in JP-A-63-5341, JP-A-63-106655, and JP-A-4-144446, hydroxamic acids described in JP-A-63-43138, hydrazines and hydrazides described in JP-A-63-146041, phenols described in JP-A-63-44657 and 3-58443, α-hydroxyketones and α-aminoketones described in JP-A-63-44656, and various sugars described in JP-A-63-36244. Further, there can be used in combination with the above compounds, monoamines described in JP-A-63-4235, JP-A-63-24254, JP-A-63-21647, JP-A-63-146040, JP-A-63-27841, and JP-A-63-25654, diamines described in JP-A-63-30845, JP-A-63-14640, and JP-A-63-43139, polyamines described in JP-A-63-21647, JP-A-63-26655, and JP-A-63-44655, nitroxy radicals described in JP-A-63-53551, alcohols described in JP-A-63-43140 and JP-A-63-53549, oximes described in JP-A-63-56654, and tertiary amines described in JP-A-63-239447.

In addition to the above, the color developing solution may contain as a preservative according to necessity, various metal compounds described in JP-A-57-44148 and JP-A-57-53749, salicylic acids described in JP-A-59-180588, alkanolamines described in JP-A-54-3582, polyethyleneimines described in JP-A-56-94349, and the aromatic polyhydroxy compounds described in U.S. Pat. No. 3,746,544.

A particularly preferred preservative is a hydroxylamine represented by Formula (I) in JP-A-3-14446, and among them, preferred is a compound having a methyl, ethyl, sulfo or carboxy substituent. The addition amount of these preservatives is 20 to 200 mmole, preferably 30 to 150 mmole per liter of color developing solution.

In addition to the above, various additives described in above JP-A-3-144446 (JP-A-'446) can be used in the color developing solution. There are applied, for example, as a buffer agent for maintaining pH, carbonic acids, phosphoric acids, boric acids, and hydroxybenzoic acids each described at page 9 of the above JP-A-'466 patent, and as a chelating agent, various aminopolycarboxylic acids, phosphonic acids, and sulfonic acids, preferably ethylenediaminetetraacetic acid, triethylenetetraminehexaacetic acid, 1,3-diaminopropanoltetraacetic acid, diethylenetriaminepentaacetic acid, ethylenediamine-N,N,N',N'-tetrakis(methylenephosphonic acid), catechol-3,5-disulfonic acid each described at the above page 9 of JP-A-'466. The color developing solution is maintained preferably at pH ranging between 10 to 12.5, more preferably 10 to 11.5.

Various additives described at, for example, pages 9 to 10 of the above JP-A-'466 patent can be used as a development accelerator.

A halide ion and an organic anti-fogging agent described at page 10 of the above JP-A-'466 patent can be enumerated as an anti-fogging agent. In particular, in the case where the concentration of a developing agent contained in a color developing solution is as high as 20 millimole/liter or more and a high temperature processing of 40° C. or more is carried out, a higher bromide ion concentration is preferred and 25 millimole/liter or more is desired.

Further, there may be added according to necessity, various surface active agents such as alkylsulfonic acid, arylsulfonic acid, aliphatic carboxylic acid,- and organic carboxylic acid.

In color development, a low replenishing processing is preferred. In the case where only a conventional DIR coupler is used in a large amount, the addition of a sufficiently effective amount thereof can provide an unfavorable result in some cases since the photographic performances fluctuate in continuous processing. However, the use of the coupler of the present invention with the constitution according to the present invention has enabled a low replenishing. The replenishing amount is preferably 75 to 600 ml, more preferably 75 to 500 ml, and further more preferably 75 to 350 ml per $m^2$ of a silver halide color photographic light-sensitive material.

The processing temperature is preferably 38° C. or higher, more preferably 40° C. or higher and 50° C. or lower. The processing time of color development is preferably 3 minutes and 15 seconds or less, more preferably 2 minutes and 30 seconds or less.

The bromide concentration in a replenishing solution is preferably $3\times10^{-3}$ mole/liter or less, particularly preferably $3\times10^{-4}$ mole/liter or less.

The light-sensitive material subjected to color development is generally subjected to a desilvering process. The desilvering process mentioned herein consists fundamentally of a bleaching process and a fixing process. The desilvering process may be a bleach-fixing process in which these processes are carried out at the same time, or can be a combination of these processes.

Aminopolycarboxylic acid ferric salt or a corresponding salt of another multivalent metal is preferably used as a bleaching agent, as described at page 11 of above mentioned JP-A-3-144446. Further, there are preferably used as well, the compounds described in JP-A-4-127145, carbamoyl series bleaching agents described in JP-A-4-73647, and the bleaching agents having a hereto ring described in JP-A-4-174432.

In addition to the bleaching agents, there can be used for a desilvering process bath, a rehalogenation agent described at page 12 of the above JP-A-'466 patent, a pH buffer agent and a conventional additive, aminopolycarboxylic acids, and organic phosphonic acids.

Various bleaching accelerators can be added to a bleaching solution and the preceding bath thereof. There can be used as such the bleaching accelerators, the compounds having a mercapto group or a disulfide group, described in, for example, U.S. Pat. No. 3,893,858, German Patent 1,290,812, British Patent 1,138,842, JP-A-53-95630, and *Research Disclosure* No. 17129 (July 1978); the thiazolidine compounds described in JP-A-50-140129; the thiourea compounds described U.S. Pat. No. 3,706,561; iodides described in JP-A-58-16235; polyethyleneoxides described in German Patent 2,748,430; and the polyamine compounds described in JP-B-45-8836. Particularly preferred are the mercapto compounds described in British Patent 1,138,842 and JP-A-2-190856.

There can be incorporated into a processing solution having a fixing ability as a preservative, sulfites (for example, sodium sulfite, potassium sulfite, and ammonium sulfite), hydroxylamines, hydrazines, the bisulfite adduct of an aldehyde compound (for example, sodium acetaldehyde bisulfite, particularly preferably the compounds described in JP-A-3-158848), or the sulfinic acid compounds described in JP-A-1-231051. Further, there can be incorporated thereinto, various fluorescent whitening agents, defoaming agents, surface active agents, polyvinylpyrrolidone, and an organic solvent such as methanol. Further, a chelating agent such as various aminopolycarboxylic acids and organic phosphonic acids are preferably added to the processing solution having the fixing ability for the purpose of stabilizing the processing solution. There can be enumerated as the preferred chelating agent, 1-hydroxyethylidene-1,1-diphosphonic acid, ethylenediamine-N,N,N',N'-tetrakis(methylenephosphonic acid), nitrilotrimethylenephosphonic acid, ethylenediaminetetracetic acid, diethylenetriaminepentaacetic acid, cyclohexanediaminetetraacetic acid, and 1,2-propylenediamineteraacetic acid.

The compounds having a pKa of 6.0 to 9.0 are preferably incorporated into the processing solution having the fixing ability for the purpose of controlling pH or as a buffer agent. Imidazole compounds are preferred as these compounds. The imidazole compounds are added preferably in the amount of 0.01 mole/liter or more of the processing solution. The more preferred addition amount of the imidazole compounds is 0.1 to 10 mole/liter, particularly preferably 0.2 to 3 mole/liter.

Suitable imidazole compounds represent imidazole and substituted imidazoles, and there can be enumerated as the preferred substituent for imidazole, an alkyl group, an alkenyl group, an alkynyl group, an amino group, a nitro group, and a halogen atom. Further, it may be substituted with an alkyl group, an alkenyl group, an alkynyl group, an amino group, a nitro group, and a halogen atom. The preferred total carbon number of the substituents for imidazole is 1 to 6, and the most preferred substituent is methyl. To be specific, the preferred compounds are imidazole, 2-methylimidazole, and 4-methyl-imidazole, and the most preferred compound is imidazole.

The processing solution having a fixing ability is subjected preferably to a silver recovery processing. In case of a processing solution having a bleaching ability, an overflow of the processing solution is stored and subjected to regeneration by using a regenerant to enable reuse of the overflow. The solution having a fixing ability and the solution having a bleaching ability may be used independently of each other, or may be used as a bleach-fixing solution. In the case where the solution having the fixing ability and the solution having the bleaching ability are independently used, a waste solution is mainly the solution having the fixing ability, or the solution having the fixing ability is subjected to an inline silver recovery and the waste solution obtained after finishing the silver recovery is discharged. In addition to the inline silver recovery, all of the overflow is subjected to the silver recovery processing and the solution obtained after finishing the silver recovery may be regenerated and reused. In case of a bleach-fixing solution, the solution is subjected to the inline silver recovery and the waste solution obtained after finishing the silver recovery is discharged, and the overflow of the bleach-fixing solution is regenerated and reused.

The above processing solution having a fixing ability can be subjected to silver recovery by a known method, and effective as a silver recovering method are an electrolysis method (described in French Patent 2,299,667), a settling method (described in JP-A-52-73037 and German Patent 2,331,220), an ion exchange method (described in JP-A-51-17114 and German Patent 2,548,237), and a metal substitution method (described in British Patent 1,353,805). The prosecution of these silver recovering methods from a tank solution in the line is preferred since rapid processing is further improved.

In the present invention, the processing temperature in the desilvering process consisting of bleaching, bleach-fixing and fixing is 40° to 60° C., preferably 40° to 55° C., and the pH is 3.0 to 7.0, preferably 4.0 to 6.0. The processing time in the above desilvering process is preferably 4 minutes or less, more preferably 3 minutes or less.

After finishing a processing step having a fixing ability, the silver halide color photographic material is usually subjected to a water washing processing step or a stabilization processing step. There can be used a simple processing method in which after finishing the processing in the solution having the fixing ability, a stabilization processing with a stabilizing solution is carried out without substantially carrying out washing.

Various surface active agents can be incorporated into washing water used in the washing process and the stabilizing solution used in the stabilizing process for the purpose of preventing unevenness due to water drop in drying. Among them, a nonionic surface active agent is preferably used and in particular, an alkylphenolethylene oxide adduct is preferred. Octyl-, nonyl-, dodecyl-, and dinonylphenols are particularly preferred as the alkylphenol moiety in the adduct. The addition mole number of ethylene oxide in the adduct is particularly preferably 8 to 14. Further, a silicon series surface active agent having a defoaming effect is preferably used as well.

Various bactericides and fungicides can be incorporated into the washing water and stabilizing solution in order to prevent the generation of water grime and mold grown on a light-sensitive material after processing. Further, various chelating agents are preferably incorporated into the washing water and the stabilizing solution. There can be enumerated as the preferred chelating agent, aminopolycarboxylic acids such as ethylenediaminetetracetic acid and diethylenetriaminepentaacetic acid, organic phosphonic acids such as 1-hydroxyethylidene-1,1-diphosphonic acid, ethylenediaminetetracetic acid, and diethylenetriamine-N,N,N',N'-tetramethylenephosphonic acid, and the hydrolysis product of the maleic anhydride polymer described in EP-A-1345172.

Further, the above preservatives which can be incorporated into the fixing solution and the bleach-fixing solution are preferably incorporated as well into the washing water and the stabilizing solution.

In washing or stabilizing, processing by a multi-stage countercurrent system is preferred. The multi-stage countercurrent system which may be used can be applied to a transporting system which is provided with a conventional crossover rack. In order to improve washing efficiency, particularly preferred is a counter-current washing in a multi-chamber washing system in which a washing bath is divided into multi-chambers to squeeze in a solution at a bulkhead part, as described in JP-A-2-240651. There are needed for the number of the multi-chambers, two or more chambers, preferably three or more chambers, and more preferably four or more chambers. The washing efficiency is preferably increased with reverse osmosis equipment. The specification of the reverse osmosis equipment is preferably that water obtained after being transmitted through a reverse osmosis membrane is introduced into the following bath of a washing or stabilizing bath and a condensed solution is introduced into the preceding bath thereof, and most preferably that transmitted water is introduced into the final bath and the condensed solution is introduced into the front bath thereof.

There can be used as a stabilizing solution used in a stabilizing process, a processing solution for stabilizing a dye image, for example, a solution containing an organic acid or having a buffer function with a pH of 3 to 6, and a solution containing aldehyde (for example, formalin and glutaraldehyde). The stabilizing solution can contain all compounds which can be added to washing water. In addition thereto, there can be used according to necessity, an ammonium compound such as ammonium chloride and ammonium sulfite, the metal compounds of Bi and Al a fluorescent whitening agent, a hardener, and alkanolamine described in U.S. Pat. No. 4,786,583.

Further, the stabilizing solution contains compounds for stabilizing a dye image, for example, formalin, benzaldehydes such as m-hydroxybenzaldehyde, hexamethyleneteramine and the derivatives thereof, hexahydrotriazine and the derivatives thereof, an N-methylol compound such as dimethylolurea and N-methylolpyrazole, organic acid, and a pH buffer agent. The preferred addition amount of these compounds is 0.001 to 0.02 mole per liter of the stabilizing solution. The lower concentration of free aldehyde contained in the stabilizing solution is preferred since less formaldehyde gas is discharged. Preferred as a dye image stabilizer from this point of view are N-methylolazoles described in JP-A-3-318644, such as m-hydroxybenzaldehyde, hexamethylenetetramine, and N-methylolpyrazole, and azolylmethylamines described in JP-A-3-142708, such as N,N'-bis(1,2,4-triazole-1-ylmethyl)piperazine. Further, in addition thereto, preferably incorporated according to necessity are an ammonium compound such as ammonium chloride and ammonium sulfite, the metal compounds of Bi and Al a fluorescent whitening agent, a hardener, alkanolamine described in U.S. Pat. No. 4,786,583, and the preservatives which can be incorporated into the above mentioned fixing solution an bleach-fixing solution. Of them, preferred are the sulfinic compounds (for example, benzenesulfinic acid, toluenesulfinic acid, and the sodium and potassium salts thereof) described in JP-A-1-231051. The addition amount thereof is preferably $1\times10^{-5}$ to $1\times10^{-3}$ mole, particularly preferably $3\times10^{-3}$ to $5\times10^{-4}$ mole per liter of the stabilizing solution.

The pH value of the stabilizing solution is preferably 6 to 9, more preferably 6.5 to 8.

The replenishing amount in the washing process and the stabilizing process is 1 to 50 times, preferably 1 to 20 times, and more preferably 1 to 7 times the carried-over amount from a preceding bath per unit area. The processing time is preferably 2 minutes and 30 seconds or less, more preferably 1 minute and 30 seconds or less in terms of the whole processing time in the washing process and/or the stabilizing process.

City water can be used as water used in these washing process and stabilizing process. Preferably used is water which has been subjected to a deionization processing to provide the water with Ca and Mg ion concentrations of 5 mg/liter or less with an ion exchange resin, and water sterilized with a halogen and UV bactericidal lump.

Then, a process in which the overflow solution from the washing process or the stabilizing process is flowed in a bath having a fixing ability, which is the preceding bath thereof, can be used to reduce the waste solution amount.

In the processing according to the present invention, a suitable amount of water, or a correcting solution, or a processing replenishing solution is preferably added as replenishment to a processing solution in order to correct the concentration due to evaporation. The specific method for replenishing water is not specifically limited. Among them, preferred are the method in which a monitoring water bath is disposed independently from a bleaching bath to obtain the evaporated amount of water in the monitoring water bath and calculate the evaporated amount of water in the bleaching bath from this evaporated amount of water and water proportional to this evaporated amount is replenished to the bleaching bath, described in JP-A-1-254959 and JP-A-1-254960, and the evaporation correcting method in which a liquid level sensor and an overflow sensor are used, described in JP-A-3-248155, JP-A-3-249644, JP-A-3-249645, and JP-A-3-249646. City water may be used for water for correcting the evaporated amounts of the respective processing solutions. Preferably used are water used in the above washing process subjected to a deionization processing, and sterilized water.

The area (an opening area) in which a solution contacts air is preferably as small as possible from the viewpoints of preventing the evaporation and deterioration of the solution. For example, based on the opening ratio obtained by dividing an opening area ($cm^2$) with the volume ($cm^3$) of the processing solution, the opening ratio is preferably 0.01 ($cm^{-1}$) or less, more preferably 0.005 or less.

In the present invention, the respective processing solutions are used at 10° to 50° C. Usually, a temperature of 33° to 38° C. is standard. The processing is accelerated at an elevated temperature to shorten processing time, or on the contrary, the temperature can be lowered to achieve improvements in image quality and stability of the processing solution.

The silver halide color photographic light-sensitive material of the present invention more easily demonstrates the effects and is effective in the case where it is applied to a film unit with a lens described in JP-B-2-32615 and JP-B-U-3-

3-39784 (the term "JP-B-U" as used herein means an examined Japanese utility model publication).

EXAMPLES

The present invention will be explained below in more details with reference to the examples, but the present invention is not be limited thereto.

EXAMPLE 1

The following layers were coated on a subbed polyethylene 2,6-dinaphthalate support, in which a thickness of the support has 85 μ, on the opposite side of an emulsion layer on which a magnetic material for a magnetic recording is coated so as to be 0.10 of yellow optical density of the magnetic recording material, whereby there was prepared Sample 101 which was a multi-layer color light-sensitive material comprising the respective layers having the following compositions.

Composition of the light-sensitive layers:

The primary materials used for the respective layers are classified as follows:

ExC: Cyan coupler

ExM: Magenta coupler

ExY: Yellow coupler

ExS: Sensitizing dye

UV: UV absorber

HBS: High boiling organic solvent

H: Gelatin hardener

The coated amounts are expressed in terms of g/m$^2$ of silver for silver halide and colloidal silver, in terms of g/m$^2$ for the couplers, additives and gelatin, and in terms of mole per mole of silver halide contained in the same layer for the spectral sensitizers.

| | |
|---|---|
| First layer (an anti-halation layer) | |
| Black colloidal silver | 0.20 |
| Gelatin | 1.00 |
| ExM-1 | $2.0 \times 10^{-2}$ |
| HBS-1 | $3.0 \times 10^{-2}$ |
| Second layer (an intermediate layer) | |
| Gelatin | 1.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| HBS-2 | $7.0 \times 10^{-2}$ |
| Third layer (a low speed red-sensitive emulsion layer) | |
| Silver bromoiodide emulsion A silver | 0.30 |
| Silver bromoiodide emulsion B silver | 0.25 |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.11 |
| ExC-3 | 0.11 |
| ExY-1 | $3.0 \times 10^{-2}$ |
| ExC-7 | $1.0 \times 10^{-2}$ |
| HBS-1 | $7.0 \times 10^{-3}$ |
| Fourth layer (a middle speed red-sensitive emulsion layer) | |
| Silver bromoiodide emulsion C silver | 0.35 |
| Silver bromoiodide emulsion D silver | 0.60 |
| Gelatin | 1.80 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.16 |
| ExC-2 | $8.0 \times 10^{-2}$ |
| ExC-3 | 0.17 |
| ExC-7 | $1.5 \times 10^{-2}$ |
| ExY-1 | $2.0 \times 10^{-2}$ |
| ExY-2 | $1.0 \times 10^{-2}$ |
| Cpd-10 | $1.0 \times 10^{-4}$ |
| HBS-1 | 0.10 |
| Fifth layer (a high speed red-sensitive emulsion layer) | |
| Silver bromoiodide emulsion E silver | 1.00 |
| Gelatin | 1.40 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| ExC-7 | $1.5 \times 10^{-2}$ |
| ExY-1 | $1.0 \times 10^{-2}$ |
| HBS-1 | 0.15 |
| HBS-2 | $8.0 \times 10^{-2}$ |
| Sixth layer (an intermediate layer) | |
| Gelatin | 0.60 |
| P-2 | 0.17 |
| Cpd-1 | 0.10 |
| Cpd-4 | 0.17 |
| HBS-1 | $5.0 \times 10^{-2}$ |
| Seventh layer (a low speed green-sensitive emulsion layer) | |
| Silver bromoiodide emulsion F silver | 0.15 |
| Silver bromoiodide emulsion G silver | 0.20 |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-1 | $3.0 \times 10^{-2}$ |
| ExM-2 | 0.20 |
| ExY-1 | $3.0 \times 10^{-2}$ |
| Cpd-11 | $7.0 \times 10^{-3}$ |
| HBS-1 | 0.20 |
| Eighth layer (a middle speed green-sensitive emulsion layer) | |
| Silver bromoiodide emulsion H silver | 0.70 |
| Gelatin | 0.90 |
| ExS-4 | $5.0 \times 10^{-4}$ |
| ExS-5 | $2.0 \times 10^{-4}$ |
| ExS-6 | $3.0 \times 10^{-5}$ |
| ExM-1 | $3.0 \times 10^{-2}$ |
| ExM-2 | 0.25 |
| ExM-3 | $1.5 \times 10^{-2}$ |
| ExY-1 | $4.0 \times 10^{-2}$ |
| Cpd-11 | $9.0 \times 10^{-3}$ |
| HBS-1 | 0.20 |
| Ninth layer (a high speed green-sensitive emulsion layer) | |
| Silver bromoiodide emulsion I silver | 0.90 |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-1 | $1.0 \times 10^{-2}$ |
| ExM-4 | $3.9 \times 10^{-2}$ |
| ExM-5 | $2.6 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| HBS-1 | 0.20 |
| HBS-2 | $5.0 \times 10^{-2}$ |
| Tenth layer (a yellow filter layer) | |
| Gelatin | 0.70 |
| Yellow colloidal silver | $5.0 \times 10^{-2}$ |
| Cpd-1 | 0.20 |

-continued

| | |
|---|---|
| HBS-1 | 0.15 |
| Eleventh layer (a low speed blue-sensitive emulsion layer) | |
| Silver bromoiodide emulsion J silver | 0.10 |
| Silver bromoiodide emulsion K silver | 0.20 |
| Gelatin | 1.00 |
| ExS-8 | $2.0 \times 10^{-4}$ |
| ExY-1 | $9.0 \times 10^{-2}$ |
| ExY-3 | 0.90 |
| Cpd-2 | $1.0 \times 10^{-2}$ |
| HBS-1 | 0.30 |
| Twelfth layer (a high speed blue-sensitive emulsion layer) | |
| Silver bromoiodide emulsion L silver | 0.80 |
| Gelatin | 0.60 |
| ExS-8 | $1.0 \times 10^{-4}$ |
| ExY-3 | 0.12 |
| Cpd-2 | $1.0 \times 10^{-3}$ |
| HBS-1 | $4.0 \times 10^{-2}$ |
| Thirteenth layer (a first protective layer) | |
| Silver bromoiodide fine grains (average grain size: 0.07 μm, AgI: 1 mole %) | 0.20 |
| Gelatin | 0.80 |
| UV-2 | 0.10 |
| UV-3 | 0.10 |
| UV-4 | 0.20 |
| HBS-3 | $4.0 \times 10^{-2}$ |
| P-3 | $9.0 \times 10^{-2}$ |
| Fourteenth layer (a second protective layer) | |
| Gelatin | 0.70 |
| B-1 (diameter: 1.5 μm) | 0.10 |
| B-2 (diameter: 1.5 μm) | 0.10 |
| B-3 | $2.0 \times 10^{-2}$ |
| H-1 | 0.40 |

Further, following Cpd-3, Cpd-5 to Cpd-8, P-1, P-2, and W-1 to W-3 were added in order to improve preservation performance, processing performance, anti-pressure performance, anti-mold and fungicidal performances, anti-electrification performance, and a coating performance.

In addition to the above, B-4, F-1 to F-11, an iron salt, a lead salt, a gold salt, a platinum salt, an iridium salt, and a rhodium salt were appropriately incorporated into the respective layers.

Next, the list of the emulsions used in the present invention and the chemical structures or chemical names of the compounds are shown below.

TABLE 2

| Emulsion | Grain structure = (silver amount molar ratio-core/middle/shell] (AgI content mol %)], Grain form | |
|---|---|---|
| A | Uniform structure | cubic grain |
| B | Uniform structure | cubic grain |
| C | Triple structure = | [4/1/5] (1/38/1) cubic grain |
| D | Triple structure = | [4/1/5] (1/38/1) cubic grain |
| E | Triple structure = | [12/59/29] (0/11/8) tabular grain |
| F | Triple structure = | [45/5/50] (1/38/1) octahedral grain |
| G | Triple structure = | [45/5/50] (1/38/1) octahedral grain |
| H | Triple structure = | [4/1/5] (1/38/1) octahedral grain |
| I | Triple structure = | [12/59/29] (0/11/8) tabular grain |
| J | Uniform structure | tabular grain |
| K | Uniform structure | tabular grain |
| L | Triple structure = | [8/59/33] (0/11/8) tabular grain |

In Tables 1 and 2:

(1) the respective emulsions were subjected to a reduction sensitization with thiourea dioxide and thiosulfonic acid in the preparation of the grains according to the examples of JP-A-2-191938;

(2) the respective emulsions were subjected to a gold sensitization, a sulfur sensitization and a selenium sensitization in the presence of the spectral sensitizing dyes described in the above respective layers and sodium thiocyanate according to the examples of Japanese Patent Application No. 2-34090;

(3) low molecular weight gelatin was used in the preparation of the tabular grains according to the examples of JP-A-1-158426; and (4) the dislocation lines described in Japanese Patent Application No. 2-34090 were observed in the tabular grains and regular crystal grains having a grain structure with a high pressure electron microscope.

TABLE 1

| Emulsion | Average AgI content (%) | Average grain size/sphere-corresponding size (μm) | Variation coefficient in grain size distribution (%) | Diameter/thickness ratio | Average projected area circle-corresponding size (μm) | Average thickness (μm) |
|---|---|---|---|---|---|---|
| A | 2.0 | 0.2 | 12 | 1 | — | — |
| B | 2.0 | 0.3 | 14 | 1 | — | — |
| C | 4.7 | 0.3 | 12 | 1 | — | — |
| D | 4.7 | 0.5 | 8 | 1 | — | — |
| E | 8.8 | 0.65 | 22 | 6.5 | 1.06 | 0.16 |
| F | 2.9 | 0.15 | 16 | 1 | — | — |
| G | 2.9 | 0.25 | 18 | 1 | — | — |
| H | 4.7 | 0.45 | 10 | 1 | — | — |
| I | 8.8 | 0.60 | 25 | 7.2 | 1.01 | 0.14 |
| J | 3.0 | 0.2 | 30 | 4.5 | 0.29 | 0.064 |
| K | 3.0 | 0.5 | 26 | 7.0 | 0.84 | 0.12 |
| L | 9.0 | 0.85 | 23 | 6.5 | 1.39 | 0.21 |

In the above Table 1, the value of average grain size/sphere-corresponding size and the value of average

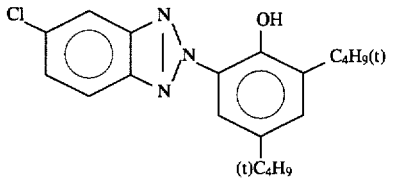
UV-1
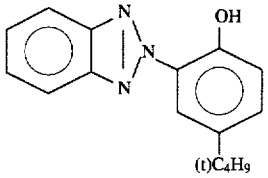
UV-2
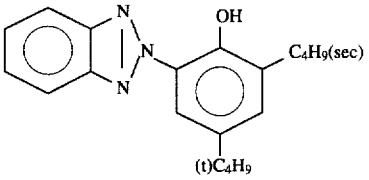
UV-3
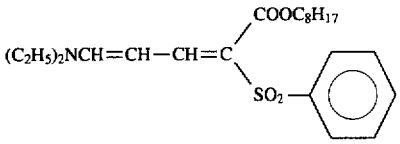
UV-4
Tricresyl phosphate HBS-1
Dibutyl phthalate HBS-2
Tri(2-ethylhexyl) phosphate HBS-3
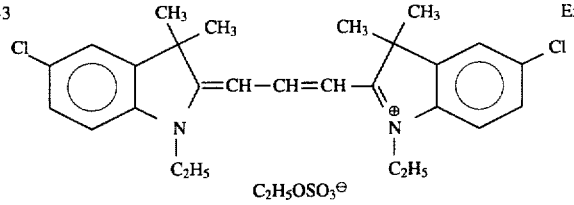
ExF-1
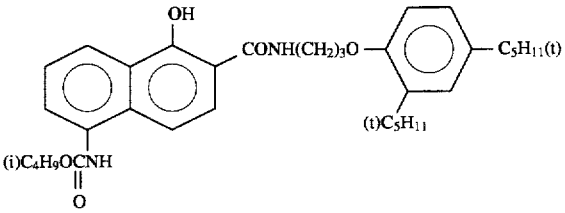
ExC-1
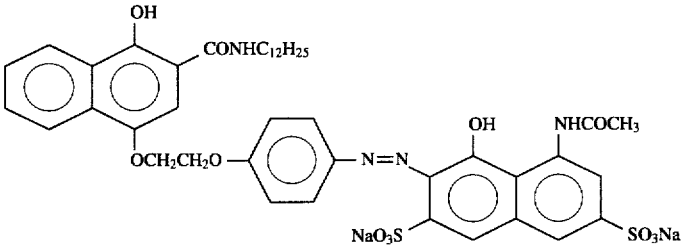
ExC-2
ExC-3 (Coupler 27 described in JP-A-57-151944)
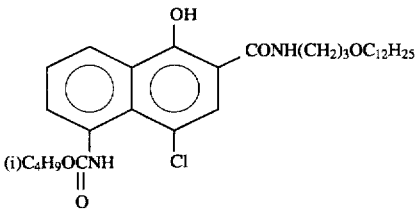
ExC-4
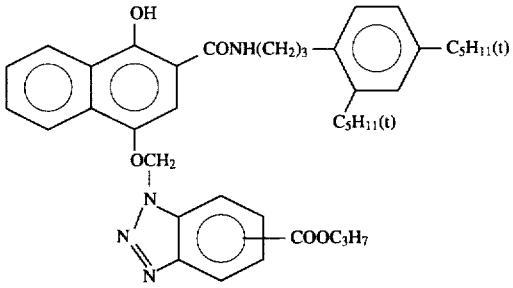
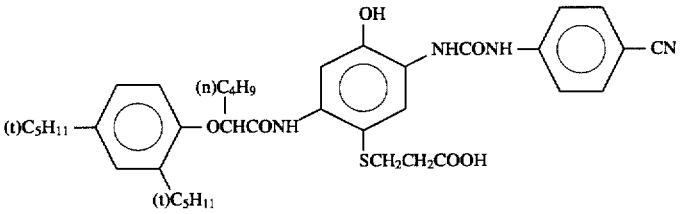
ExC-5

-continued
ExC-6
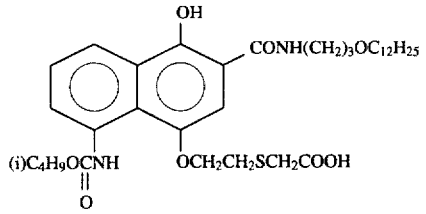
ExC-7
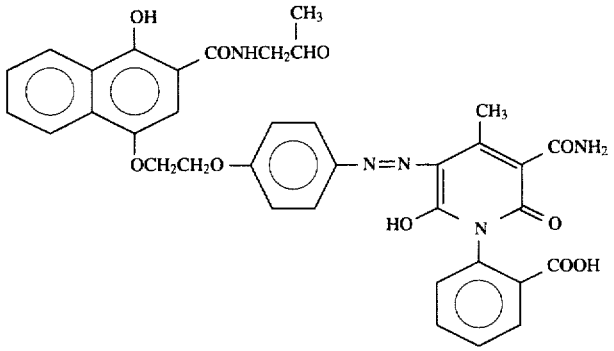
ExM-1
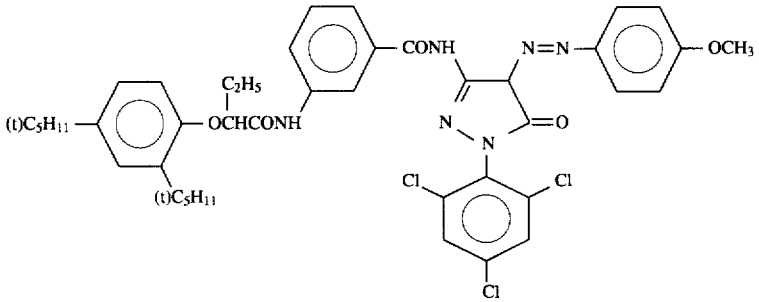
ExM-2
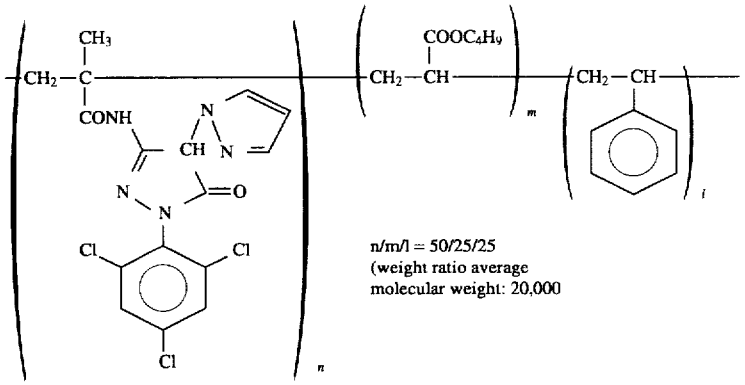
ExM-3
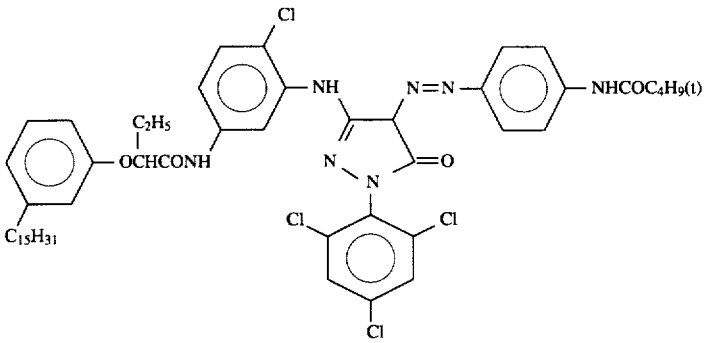

-continued
ExM-4
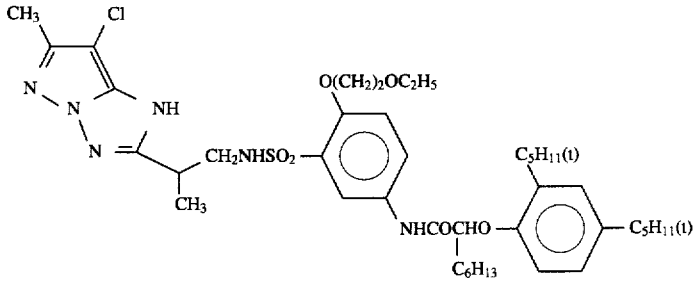
ExM-5
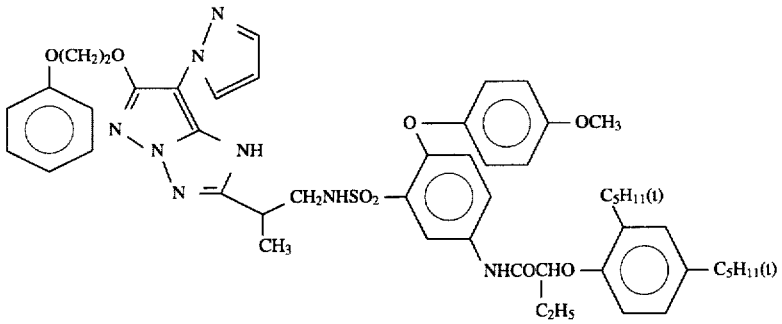
ExY-1
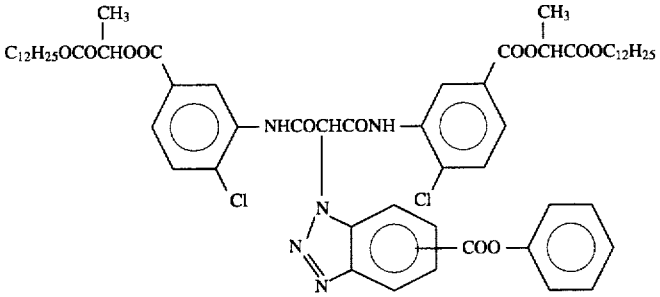
ExY-2
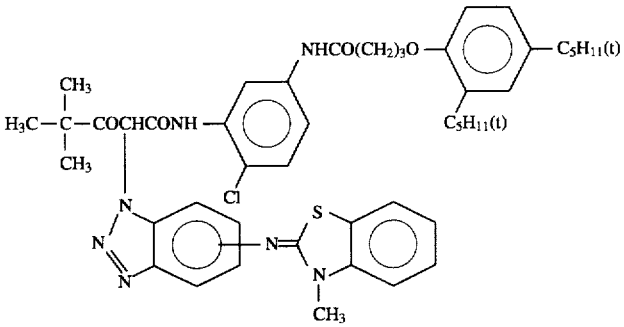
ExY-3
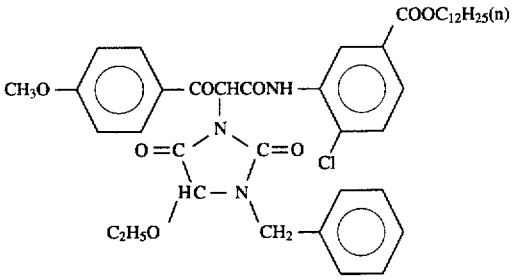

-continued
Cpd-1
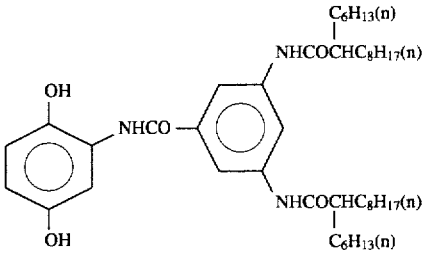
Cpd-2
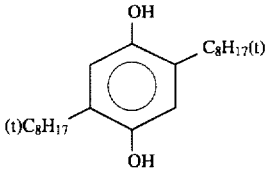
Cpd-3
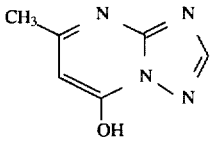
Cpd-4
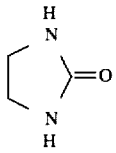
Cpd-5
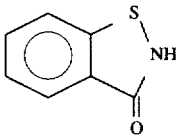
Cpd-6
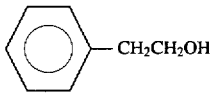
Cpd-7
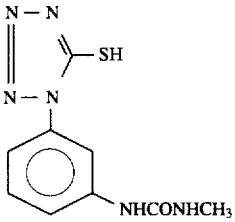
Cpd-8
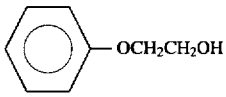
Cpd-9
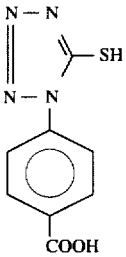
Cpd-10
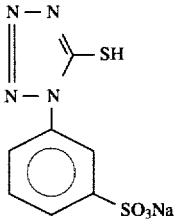
Cpd-11
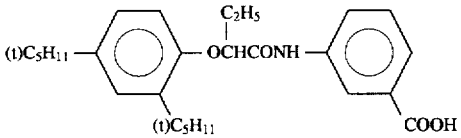
ExS-1
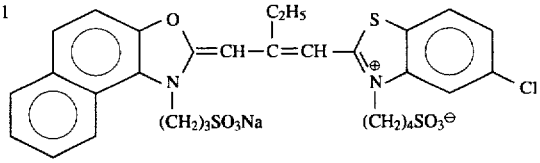
ExS-2
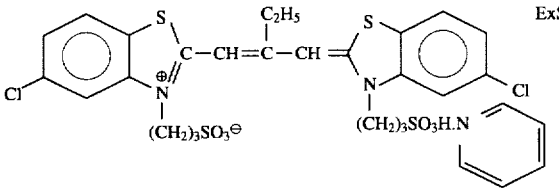
ExS-3
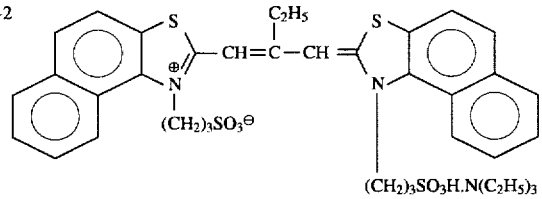
ExS-4
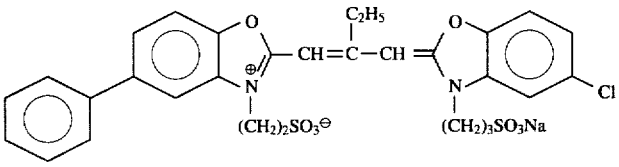

-continued
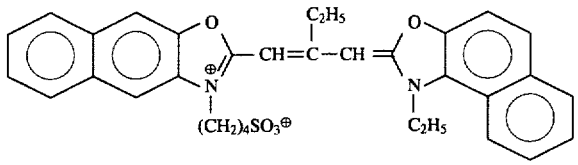
ExS-5
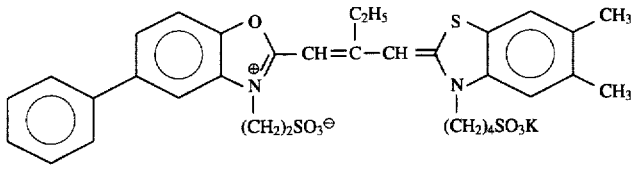
ExS-6
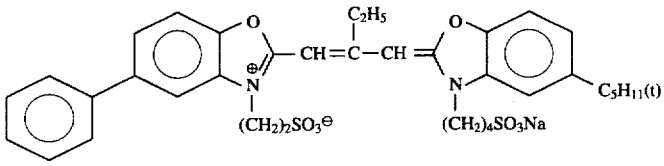
ExS-7
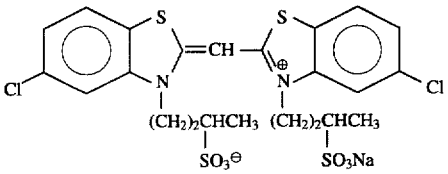
ExS-8
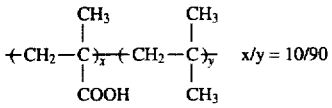
x/y = 10/90
B-1
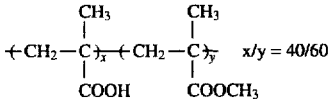
x/y = 40/60
B-2
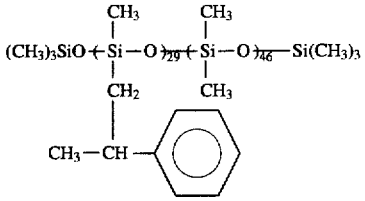
B-3
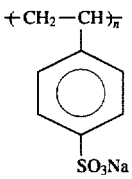
average molecular weight: about 1,000,000.
B-4
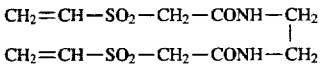
H-1
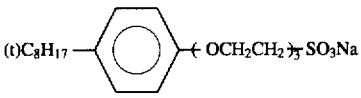
W-1
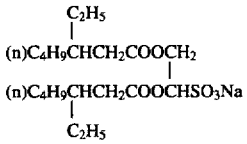
W-2
$C_8H_{17}SO_2N(C_3H_7)CH_2COOK$
W-3
Copolymer of vinylpyrrolidone and vinyl alcohol (copolymerization ratio = 70:30 by weight)
P-1
Polyvinyl pyrrolidone (average molecular weight: about 10,000)
P-2
Polyethyl acrylate
P-3
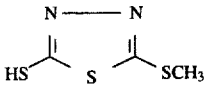
F-1
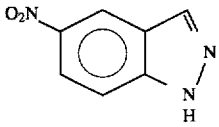
F-2
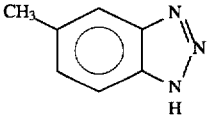
F-3
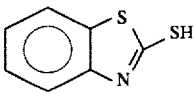
F-4

-continued

F-5

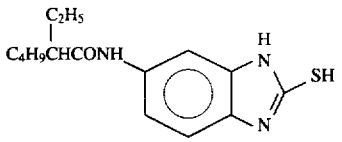

F-6

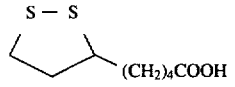

F-7

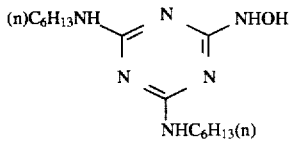

F-8

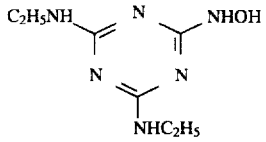

F-9

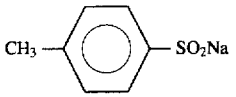

F-10

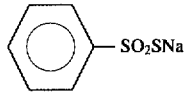

F-11

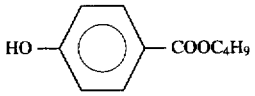

Samples 102 to 104:

ExY-1 contained in the third layer, the fourth layer and the fifth layer of Sample 101 was replaced with ExC-4 in a 2.5 times molar amount (Coupler 27 described in JP-A-57-151944), E-3 in a 1.2 times molar amount (Coupler 10 described-in JP-A-3-198048), and D-8 in a 1.2 times molar amount (Coupler 14 described in JP-A-3-228048, respectively, whereby Samples 102 to 104 were prepared.

Samples 105 and 106:

ExY-1 contained in the seventh layer, the eighth layer and the eleventh layer of Sample 101 was replaced with D-14 in a 1.5 times molar amount (Coupler 16 described in U.S. Pat. No. 4,782,012) to obtain Sample 105 and with E-3 in a 1.2 times molar amount to obtain Sample 106.

Samples 107 to 112:

ExY-1 contained in Sample 101 was replaced with the couplers of the present invention as shown in Table 3, whereby Samples 107 to 112 were prepared. The addition amounts of D-5, D-6, D-17, E-4, E-5, E-10, and E-11 to ExY-1 were set at 2.5, 1.6, 1.3, 1.8, 1.6, 1.3 and 1.4 times mole, respectively.

After subjecting these samples to an even green color exposure, they were subjected to a red color imagewise exposure and then to the following color development. The value obtained by deducting a magenta density at the point of a cyan fog density from a magenta density at a cyan density (fog+1.0) was obtained as the color turbidity of magenta in a cyan dye image. Similarly, after subjecting the samples to an even green color exposure, they were subjected to a blue color imagewise exposure to thereby obtain a magenta color turbidity in a yellow dye image.

Samples 101 to 112 were slitted to a width of 35 mm to process them to a 135 size and 24 photographing exposures. Then, a 10 mm×1 mm portion thereof were subjected to an X-ray irradiation and to the following color development at a linear velocity of 10 cm/min. The difference in the densities of a yellow color at the front exposure and end exposure of the X-ray irradiated portions was evaluated as a processing unevenness.

Further, each of these samples was loaded in Minolta α-7700i and a 18% gray plate was photographed therewith at ISO 100, and 100 rolls were continuously processed. The respective samples were subjected to a sensitometry and a color developing exposure before and after the continuous processing to obtain a relative sensitivity change from the exposure providing a yellow density (fog+0.2).

The color development processing was carried out in the following manner.

Processing method:

| Step | Processing Time | Temperature | Replenishing Amount | Tank Capacity |
|---|---|---|---|---|
| Color developing | 3 minutes & 15 seconds | 38° C. | 900 ml | 10 l |
| Bleaching | 1 minute | 38° C. | 460 ml | 4 l |
| | the entire amount of overflowed bleaching solution was flowed into the bleach-fixing solution tank. | | | |
| Bleach-fixing | 3 minutes & 15 seconds | 38° C. | 700 ml | 8 l |
| Washing (1) | 40 seconds | 35° C. | * | 4 l |
| Washing (2) | 1 minute | 35° C. | 700 ml | 4 l |
| Stabilizing | 40 seconds | 38° C. | 460 ml | 4 l |
| Drying | 1 minute & 15 seconds | 55° C. | | |

*A countercurrent piping system from (2) to (1).
Replenishing amount is per $m^2$.

Next, the compositions of the processing solutions are shown below:

| Color developing solution | Tank Solution | Replenishing Solution |
|---|---|---|
| Diethylenetriaminepentaacetic acid | 1.0 g | 1.1 g |
| 1-Hydroxyethylidene-1,1-diphosphonic acid | 2.0 g | 2.0 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.4 g | 2.8 g |
| 4-[N-ethyl-N-(β-hydroxyethyl)amino]-2-methylaniline sulfate | 4.5 g | 5.5 g |
| Water was added to make the total quantity | 1.0 l | 1.0 l |
| pH (adjusted with potassiun | 10.05 | 10.10 |

-continued

| Color developing solution | Tank Solution | Replenishing Solution |
|---|---|---|
| hydroxide and sulfuric acid) | | |

| Bleaching solution (common to the tank solution and the replenishing solution) | |
|---|---|
| Ferric ammonium ethylenediamine-tetracetate diihydrate | 120.0 g |
| Disodium ethylenediaminetetracetate | 10.0 g |
| Ammonium bromide | 100.0 g |
| Ammonium nitrate | 10.0 g |
| Bleaching accelerator $(CH_3)_2N—CH_2—CH_2—S—S—CH_2—CH_2—N(CH_3)_2$ 2HCl | 0.005 mole |
| Aqueous ammonia (27%) | 15.0 ml |
| Water was added to make the total quantity | 1.0 l |
| pH (adjusted with aqueous ammonia and nitric acid) | 6.3 |

| Bleach-fixing solution | Tank Solution | Replenishing Solution |
|---|---|---|
| Ferric ammonium ethylene-diaminetetracetate dihydrate | 50.0 g | — |
| Disodium ethylemediamine-tetracetate | 5.0 g | 2.0 g |
| Sodium sulfite | 12.0 g | 20.0 g |
| Ammonium thiosulfate aqueous solution (700 g/liter) | 240.0 ml | 400.0 ml |
| Aqueous ammonia (27%) | 6.0 ml | — |
| Water was added to make the total quantity | 1.0 | 1.0 l |
| pH (adjusted with aqueous ammonia and acetic acid) | 7.2 | 7.3 |

Washing water (common to both of the tank solution and replenishing solution)

City water was introduced into a mixed bed type column filled with an H type strong acidic cation exchange resin (Amberlite IR-120B) and an OH type strong base anion exchange resin (Amberlite IRA-400) each manufactured by Rohm & Haas Co., Ltd. to reduce the ion concentrations of calcium and magnesium to 3 mg/liter or less, respectively, and subsequently sodium dichloroisocyanurate 20 mg/liter and sodium sulfate 0.15 g/liter were added. pH of this solution was in the range of 6.5 to 7.5.

| Stabilizing solution (common to the tank solution and the replenishing solution) | |
|---|---|
| Sodium-p-toluenesulfonate | 0.03 g |
| Polyoxycyethylene-p-monononylphenyl ether (average polymerization degree: 10) | 0.2 g |
| Disodium ethylenediaminetetracetate | 0.05 g |
| 1,2,4-Triazole | 1.3 g |
| 1,4-Bis(1,2,4-triazole-1-ylmethyl)-piperazine | 0.75 g |
| Water was added to make the total quantity | 1.0 l |
| pH | 8.5 |

TABLE 3

| Sample No. | DIR coupler in the 3rd, 4th, and 5th layer | DIR coupler in the 7th, 8th, and 11th layer | Color turbidity of magenta in cyan image | Color turbidity of magenta in yellow image | Processing unevenness | Relative sensitivity change* |
|---|---|---|---|---|---|---|
| 101 (Comp.) | ExY-1 | ExY-1 | 0.01 | −0.01 | 0.08 | −0.02 |
| 102 (Comp.) | ExC-4 | ExY-1 | −0.01 | −0.01 | 0.08 | −0.02 |
| 103 (Comp.) | E-3 | ExY-1 | −0.01 | −0.01 | 0.08 | −0.02 |
| 104 (Comp.) | D-8 | ExY-1 | −0.03 | −0.01 | 0.08 | −0.02 |
| 105 (Comp.) | ExY-1 | D-14 | 0.01 | 0.02 | 0.05 | −0.01 |
| 106 (Comp.) | ExY-1 | E-3 | 0.01 | −0.04 | 0.05 | −0.02 |
| 107 (Inv.) | D-5 | E-10 | −0.05 | −0.07 | 0.03 | 0.00 |
| 108 (Inv.) | D-6 | E-10 | −0.05 | −0.07 | 0.03 | 0.00 |
| 109 (Inv.) | D-17 | E-10 | −0.07 | −0.07 | 0.02 | 0.00 |
| 110 (Inv.) | D-17 | E-4 | −0.07 | −0.06 | 0.02 | 0.00 |
| 111 (Inv.) | D-17 | E-5 | −0.07 | −0.06 | 0.03 | 0.00 |
| 112 (Inv.) | D-17 | E-11 | −0.07 | −0.05 | 0.01 | 0.00 |

It is apparent from the results summarized in Table 3 that the samples of the present invention have an excellent color reproduction performance represented by a color turbidity and a processing unevenness in a processing direction and a sensitivity reduction immediately after a continuous processing are small and therefore that the present invention is effective.

EXAMPLE 2

The replenishing solution composition and the replenishing amount in Example 1 were changed as shown below, and the sensitivity change in a continuous processing was measured similarly to Example 1.

| Color developing solution | Tank Solution | Replenishing Solution |
|---|---|---|
| Diethylenetriaminepentaacetic acid | 2.0 g | 2.0 g |
| 1-Hydroxyethylidene-1,1-diphosphonic acid | 2.0 g | 2.0 g |
| Sodium sulfite | 3.9 g | 5.1 g |
| Potassium carbonate | 37.5 g | 39.0 g |
| Potassium bromide | 1.4 g | 0.4 g |
| Potassium iodide | 1.3 mg | — |
| Hydroxylamine sulfate | 2.4 g | 3.3 g |
| 2-methyl-4-[N-ethyl-N-(β-hydroxyethy)amino]-aniline sulfate | 4.5 g | 6.0 g |
| Water was added to make the total quantity | 1.0 l | 1.0 l |
| pH (adjusted with potassium hydroxide and sulfuric acid) | 10.05 | 10.15 |

| Bleaching solution | Tank Solution | Replenishing Solution |
|---|---|---|
| Ferric ammonium 1,3-diamino-propanetetraacetate monohydrate | 130 g | 195 g |
| Ammonium bromide | 70 g | 105 g |
| Ammonium nitrate | 14 g | 21 g |
| Hydroxyacetic acid | 50 g | 75 g |
| Acetic acid | 40 g | 60 g |
| Water was added to make the total quantity | 1.0 l | 1.0 |
| pH (adjusted with aqueous ammonia) | 4.4 | 4.4 |

Fixing tank solution 15 to 85 (volume ratio) mixed solution of the above bleaching tank solution and the following fixing tank solution (pH 7.0).

| Fixing solution | Tank Solution | Replenishing Solution |
|---|---|---|
| Ammonium sulfite | 19 g | 57 g |
| Ammonium thiosulfate aqueous solution (700 g/liter) | 280 ml | 840 ml |
| Imidazole | 15 g | 45 g |
| Ethylenediaminetetraacetic acid | 15 g | 45 g |
| Water was added to make the total quantity | 1.0 l | 1.0 l |
| pH (adjusted with aqueous ammonia) | 7.4 | 7.45 |

Washing water

City water was introduced into a mixed bed type column filled with an H type strong acidic cation exchange resin (Amberlite and an IR-120B) OH type strong base anion exchange resin (Amberlite IRA-400) each manufactured by Rohm & Haas Co., Ltd. to reduce the ion concentrations of calcium and magnesium to 3 mg/liter or less, respectively, and subsequently sodium dichloroisocyanurate 20 mg/liter and sodium sulfate 150 mg/liter were added. pH of this solution was in the range of 6.5 to 7.5.

| Stabilizing solution (common to the tank solution and the replenishing solution) | |
|---|---|
| Sodium p-toluenesulfonate | 0.03 g |
| Polyoxyethylene-p-monononylphenyl ether (average polymerization degree: 10) | 0.2 g |
| Disodium ethylenedianinetetracetate | 0.05 g |
| 1,2,4-Triazole | 1.3 g |
| 1,4-Bis(1,2,4-triazole-1-ylmethyl)-piperazine | 0.75 g |
| Water was added to make the total quantity | 1.0 l |
| pH | 8.5 |

These samples were cut to the width of 35 mm and the cut samples subjected to photographing with a camera were subjected to the following processing by 1 $m^2$ per day over the period of 15 days.

The respective processings were carried out with the automatic developing machine FP-560B manufactured by Fuji Photo Film Co., Ltd. in the following manner.

The processing processes and the processing solution compositions are shown below.

| Processing steps | | | | |
|---|---|---|---|---|
| Step | Processing Time | Temperature | Replenishing Amount | Tank Capacity |
| Color developing | 3 minute & 5 seconds | 38.0° C. | 23 ml | 17 l |
| Bleaching | 50 seconds | 38.0° C. | 5 ml | 5 l |
| Bleach-fixing | 50 seconds | 38.0° C. | — | 5 l |
| Fixing | 50 seconds | 38.0° C. | 16 ml | 5 l |
| Washing | 30 seconds | 38.0° C. | 34 ml | 3.5 l |
| Stabilizing (1) | 20 seconds | 38.0° C. | — | 3 l |
| Stabilizing (2) | 20 seconds | 38.0° C. | 20 ml | 3 l |
| Drying | 1 minute & 30 seconds | 60° C. | | |

Replenishing amount is per 1.1 meter of the light-sensitive material with a 35 mm width (corresponding to 24 exposures in a single roll).

The stabilizing process is of a countercurrent system from (2) to (1), and all of the overflowed solution from the washing bath was introduced into the fixing bath. The bleach-fixing solution was replenished in such a manner that notches were provided at the upper part of the bleaching bath and the upper part of the fixing bath of the automatic developing machine, and all of the overflowed solutions which were generated by supplying the replenishing solutions to the bleaching bath and fixing bath were flowed in the bleach-fixing bath. The amounts of the developing solution carried over to the bleaching bath, the bleaching solution carried over to the bleach-fixing bath, the bleach-fixing solution carried over to the fixing bath, and the fixing solution carried over to the washing bath were 2.5 ml, 2.0 ml, 2.0 ml, and 2.0 ml per 1.1 meter of the light-sensitive material with a 35 mm width, respectively. The crossover time is 6 seconds at each carry over, and this time is included in the processing time of the preceding process.

The compositions of the processing solutions are shown below:

| | Replenishing amount | |
|---|---|---|
| Color developing solution | 550 ml Replenishing Solution A | 450 ml Replenishing Solution B |
| Diethylenetriaminepentacetic | 1.1 g | 1.1 g |

-continued

| | | |
|---|---|---|
| acid | | |
| 1-Hydroxyethylidenel,1-diphosphonic acid | 2.0 g | 2.0 g |
| Sodium sulfite | 5.1 g | 5.5 g |
| Potassium carbonate | 37.5 g | 38.5 g |
| Potassium bromide | 0.4 g | 0.1 g |
| Hydroxylamine sulfate | 3.3 g | 3.6 g |
| 4-[N-ethyl-N-(β-hydroxyethyl) amino]-2-methylaniline sulfate | 6.0 g | 6.5 g |
| Water was added to make the total quantity | 1.0 l | 1.0 l |
| pH adjusted with potassium (hydroxide and sulfuric acid) | 10.05 | 10.18 |

TABLE 4

| | Sensitivity change* | |
|---|---|---|
| Sample No. | Replenishing Solution A 550 ml | Replenishing Solution B 450 ml |
| 101 (Comp.) | −0.04 | −0.07 |
| 102 (Comp.) | −0.04 | −0.07 |
| 103 (Comp.) | −0.04 | −0.06 |
| 104 (Comp.) | −0.04 | −0.06 |
| 105 (Comp.) | −0.02 | −0.04 |
| 106 (Comp.) | −0.03 | −0.05 |
| 107 (Inv.) | −0.01 | −0.02 |
| 108 (Inv.) | −0.01 | −0.02 |
| 109 (Inv.) | −0.01 | −0.02 |
| 110 (Inv.) | −0.01 | −0.01 |
| 111 (Inv.) | −0.01 | −0.02 |
| 112 (Inv.) | −0.01 | −0.01 |

*in the continuous processing.

It is apparent from the results summarized in Table 4 that the samples of the present invention have less sensitivity change in the continuous processing compared with the comparative samples and particularly that while the replenishing amount in Table 3 is 900 ml, the processing in which the replenishing amount is small increases the effects thereof.

EXAMPLE 3

There were prepared samples in which D-5 contained in Samples 107 in Examples 1 and 2 was replaced with D-9, D-11 and D-13 in an amount of 0.8, 0.6 and 0.5 times molar amount of D-5, respectively, and samples in which E-10 contained in Sample 109 was replaced with E-11, E-13, E-14, and E-15 in an amount of 1.0, 0.9, 0.9 and 1.6 times molar amount of E-10, respectively. The samples thus prepared were evaluated in the same manner as those in Examples 1 and 2 to observe that the color reproduction performance represented by a color turbidity was good and the processing unevenness also was small and that the fluctuation in the photographic performances in the continuous processing was small as well.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support, and provided thereon at least one red-sensitive emulsion layer, at least one green-sensitive emulsion layer, and at least one blue-sensitive emulsion layer, and containing a coupler represented by the following Formula (I) in a red-sensitive emulsion layer and a coupler represented by the following Formula (II) in a green-sensitive and/or blue-sensitive emulsion layer:

Formula (I)

$$A_1\text{–(TIME)}_a\text{–}DI$$

Formula (II)

$$A_2\text{–(TIME)}_a\text{–}DI$$

wherein $A_1$ represents a coupler group having an anti-diffusion group and releasing $(TIME)_a$–DI upon a reaction with an oxidation product of an aromatic primary amine developing agent compound; $A_2$ represents a coupler group having no anti-diffusion group and releasing $(TIME)_a$–DI upon a reaction with an oxidation product of an aromatic primary amine developing agent; TIME represents a timing group which splits from DI after separating from $A_1$ in formula (I) or $A_2$ in formula (II); DI represents a development inhibitor which is substantially deactivated after eluting into a developing solution; and a represents 1 or 2, and when a is 2, the two TIME's are the same or different.

2. The silver halide color photographic material according to claim 1, wherein the total carbon number of at least one TIME group of Formula (I) is 8 to 40.

3. The silver halide color photographic material according to claim 1, wherein the total carbon number of at least one TIME group of Formula (I) is 10 to 22.

4. The silver halide color photographic material according to claim 1, wherein TIME is represented by the following Formula (T-1), (T-2) or (T-3):

$$*\text{—W—(X=Y)}_j\text{—C(R}_{21}\text{)R}_{22}\text{—}^{**} \qquad \text{Formula (T-1)}$$

$$*\text{—W—CO—}^{**} \qquad \text{Formula (T-2)}$$

$$*\text{—W—LINK—E—}^{**} \qquad \text{Formula (T-3)}$$

wherein * represents the position for bonding to $A_1$ or $A_2$ in Formula (I) or (II); ** represents the position for bonding to DI or TIME (when a is plural); W represents an oxygen atom, a sulfur atom, or $=N—R_{23}$; X and Y each represent a substituted or unsubstituted methine group or a nitrogen atom; j represents 0, 1 or 2 and $R_{21}$, $R_{22}$ and $R_{23}$ each represent a hydrogen atom or a substituent, wherein when X and Y represent a substituted methine, there may be either the case in which a cyclic structure is formed by a combination of any of the substituents of the substituted methine, $R_{21}$, $R_{22}$ and $R_{23}$ or the case in which such a cyclic structure is not formed; in Formula (T-3), E represents an electrophilic group, and LINK represents a linkage group sterically linking W and E so that they can be subjected to an intermolecular nucleophilic substitution reaction.

* * * * *